US012642369B2

(12) United States Patent
Yoshitsugu

(10) Patent No.: US 12,642,369 B2
(45) Date of Patent: Jun. 2, 2026

(54) DISPLAY CASE

(71) Applicant: KAWAJUN CO., LTD., Tokyo (JP)

(72) Inventor: Toru Yoshitsugu, Tokyo (JP)

(73) Assignee: KAWAJUN CO., LTD., Tokyo (JP)

( * ) Notice: Subject to any disclaimer, the term of this patent is extended or adjusted under 35 U.S.C. 154(b) by 208 days.

(21) Appl. No.: 18/268,005

(22) PCT Filed: Jan. 30, 2023

(86) PCT No.: PCT/JP2023/002826
§ 371 (c)(1),
(2) Date: Jun. 16, 2023

(87) PCT Pub. No.: WO2024/154362
PCT Pub. Date: Jul. 25, 2024

(65) Prior Publication Data

US 2024/0389769 A1 Nov. 28, 2024

(30) Foreign Application Priority Data

Jan. 18, 2023 (JP) ..... 2023-006112

(51) Int. Cl.
*A47B 87/02* (2006.01)
*A47F 3/00* (2006.01)
(Continued)

(52) U.S. Cl.
CPC ..... *A47F 3/14* (2013.01); *A47B 87/0207* (2013.01); *A47F 3/004* (2013.01); *A47F 5/10* (2013.01)

(58) Field of Classification Search
CPC . A47B 87/02; A47B 87/0207; A47B 87/0276; A47B 87/0284; A47F 3/004; A47F 3/14; A47F 5/10; B65D 5/38
(Continued)

(56) References Cited

U.S. PATENT DOCUMENTS 4,502,741 A * 3/1985 DeVries ..... A47B 87/0292 312/334.44
4,650,263 A * 3/1987 Monaghan ..... F16B 12/24 108/154
(Continued)

FOREIGN PATENT DOCUMENTS

JP 2013-31547 A 2/2013

OTHER PUBLICATIONS

International Search Report dated Mar. 14, 2023, issued in counterpart International Application No. PCT/JP2023/002826. (3 pages).
(Continued)

*Primary Examiner* — James O Hansen
(74) *Attorney, Agent, or Firm* — WHDA, LLP

(57) ABSTRACT

A display case includes: a case main body; first and second connection portions; first side-wall portions, each configured to be turnable between a first position where the first side-wall portion stands up from the case main body and a second position where the first side-wall portion falls down on the case main body, and each including first engagement portions; second side-wall portions extending along the longitudinal direction, each configured to be turnable between a third position where the second side-wall portion stands up from the case main body and a fourth position where the second side-wall portion falls down on the case main body, and each including second engagement portions; and joint portions provided at respective corners of the case main body, and each including third engagement portions engageable with and disengageable from the first engagement portions, and fourth engagement portions engageable with and disengageable from the second engagement portions.

5 Claims, 41 Drawing Sheets

(51) Int. Cl.

| | |
|---|---|
| ***A47F 3/14*** | (2006.01) |
| ***A47F 5/10*** | (2006.01) |
| ***B65D 5/38*** | (2006.01) |

(58) Field of Classification Search
USPC ..... 312/107, 108; 217/36
See application file for complete search history.

(56) References Cited

U.S. PATENT DOCUMENTS

| | | | | |
|---|---|---|---|---|
| 5,642,923 | A * | 7/1997 | Meacham | B65D 19/44 312/258 |
| 6,142,329 | A * | 11/2000 | Dotan | B65D 19/18 220/7 |
| 2007/0000856 | A1* | 1/2007 | Verna | A47F 3/14 211/126.7 |
| 2008/0169216 | A1 | 7/2008 | Kaltz | |
| 2013/0193153 | A1* | 8/2013 | Baltz | B65D 25/30 220/666 |
| 2018/0105324 | A1 | 4/2018 | Massarani et al. | |

OTHER PUBLICATIONS

Written Opinion of the International Searching Authority (Form PCT/ISA/237) dated Mar. 14, 2023, issued in counterpart International Application No. PCT/JP2023/002826. (4 pages).

* cited by examiner

DISPLAY CASE

TECHNICAL FIELD

The present invention relates to a display case in which commodities can be displayed.

BACKGROUND ART

For example, a foldable display table also functioning as a storage box is known (for example, see Patent Literature 1). In the case of the display table, the display table can be stacked on the other display table through engagement of protrusions and concave portions provided at corners.

CITATION LIST

Patent Literature

Patent Literature 1
Japanese Patent Laid-Open No. 2013-31547

SUMMARY OF INVENTION

Technical Problem

There are various display methods using the display table. For example, there are a display method in which the display table is installed upside down, and a display method in which the display table is obliquely installed. However, simple engagement of the protrusions and the concave portions as described above cannot cope with a complicated display method.

Accordingly, an object of the present invention is to provide a display case that enables various displays corresponding to applications.

Solution to Problem

The above-described problems are solved by the present invention described below. A display case according to the present invention (1) includes: a case main body having a square plate shape, and including a first surface and a second surface on a side opposite to the first surface; a frame body including a top surface and standing up from an outer edge portion of the first surface; first convex portions provided at any of first corner portions and peripheries of the first corner portions on the top surface; first concave portions provided near the respective first convex portions and each having a shape complementary to a shape of each of the first convex portions; second convex portions provided at any of second corner portions and peripheries of the second corner portions adjacent to the respective first corner portions on the top surface, and each having a shape equivalent to the shape of each of the first convex portions; and second concave portions provided near the respective second convex portions and each having a shape complementary to the shape of each of the second convex portions, in which the second concave portions are bilaterally symmetrical to the first convex portions, and each have the shape complementary to the shape of each of the first convex portions, and the second convex portions are bilaterally symmetrical to the first concave portions, and each have the shape complementary to the shape of each of the first concave portions.

A display case according to the present invention (2) is the display case according to (1) further including: third convex portions provided at any of third corner portions and peripheries of the third corner portions on the second surface opposed to the first corner portions; and third concave portions provided near the respective third convex portions and each having a shape complementary to a shape of each of the third convex portions, in which the third concave portions are provided at positions facing the respective first convex portions, and each have the shape complementary to the shape of each of the first convex portions, and the third convex portions are provided at positions facing the respective first concave portions, and each have the shape complementary to the shape of each of the first concave portions.

A display case according to the present invention (3) is the display case according to (1) further including, at a substantially center part on the second surface, fourth concave portions each complementary to each of the first convex portions.

A display case according to the present invention (4) is the display case according to (3) in which no convex portion complementary to each of the first concave portions is provided at the substantially center part on the second surface.

A display case according to the present invention (5) is the display case according to (1) in which the frame body includes first side-wall portions and second side-wall portions intersecting the first side-wall portions, and at least one of the first side-wall portions and the second side-wall portions includes a fifth concave portion complementary to each of the first convex portions, at a position that is a substantially middle part in a length direction and corresponds to the top surface.

A display case according to the present invention (6) is the display case according to (3) in which at least one of middle parts in a longitudinal direction L of the outer edge portion on the second surface and middle parts in a transverse direction S of the outer edge portion on the second surface includes a sixth concave portion complementary to each of the first convex portions.

A display case according to the present invention (7) includes: a case main body having a square plate shape, and including a first surface and a second surface on a side opposite to the first surface; paired first connection portions protruding from paired first sides of an outer edge portion of the case main body; paired second connection portions protruding from paired second sides of the outer edge portion, and protruding at positions closer to the case main body than the paired first connection portions; paired first side-wall portions each configured to be turnable between a first position where the first side-wall portion stands up from the case main body and a second position where the first side-wall portion falls down on the case main body, around the corresponding one of the paired first connection portions, and each including first engagement portions; paired second side-wall portions each configured to be turnable between a third position where the second side-wall portion stands up from the case main body and a fourth position where the second side-wall portion falls down on the case main body, around the corresponding one of the paired second connection portions, and each including second engagement portions; a plurality of placement portions provided at respective corners on the first surface of the case main body; a plurality of joint portions placed on the respective placement portions, each of the plurality of joint portions including third engagement portions engageable with and disengageable from the first engagement portions of the turning first side-wall portion, and fourth engagement portions engageable with and disengageable from the second engagement portions of the turning second side-wall portion, the plurality of joint portions being configured to turn with the first side-wall portions turning to the second position, to expose the placement portions; at least one paired third convex portions provided at paired corner portions at diagonal positions on the second surface; a plurality of first concave portions provided on respective top parts of the plurality of joint portions and each having a shape complementary to the shape of each of the third convex portions; and a plurality of seventh concave portions provided on the plurality of placement portions and each having a shape complementary to the shape of each of the third convex portions.

Advantageous Effect of Invention

According to the present invention, it is possible to provide a display case that enables various displays corresponding to applications.

DESCRIPTION OF EMBODIMENT

Figure 1:
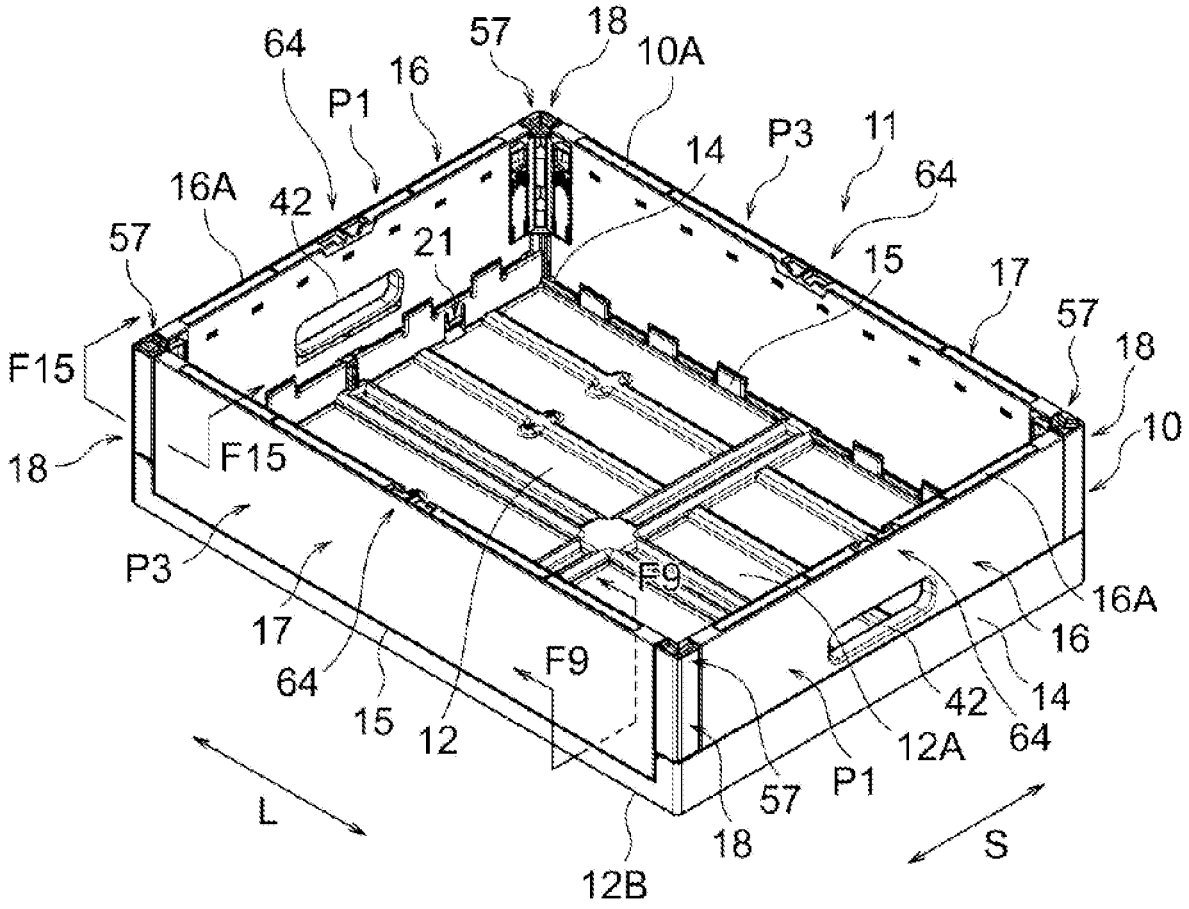
FIG. 1 is a perspective view illustrating a display case according to an embodiment.

An embodiment of a display case according to the present invention is described below with reference to drawings. The display case according to the present invention is used not only to carry in commodities from a vehicle to a backyard of a store, but also to display the commodities by being installed in a sales floor of the store. Further, the display case according to the present invention can be used for various display methods.

Embodiment

As illustrated in FIG. 1 and FIG. 5 to FIG. 7, a display case 11 includes a case main body 12 having a square plate shape. The case main body 12 includes a first surface 12A on a front side and a second surface 12B on a rear side. The display case 11 includes a frame body 10 standing up from an outer edge portion of the first surface 12A. Therefore, the display case 11 is formed in a box shape by the case main body 12 and the frame body 10. The frame body 10 includes a top surface 10A.

The display case 11 includes: paired first connection portions 14 protruding from respective first sides 13 along a transverse direction S of the outer edge portion of the case main body 12; paired second connection portions 15 protruding from respective second sides 19 along a longitudinal direction L of the outer edge portion of the case main body 12; paired first side-wall portions 16 connected to the respective first connection portions 14; paired second side-wall portions 17 connected to the respective second connection portions 15; four joint portions 18 each interposed between the first side-wall portion 16 and the second side-wall portion 17; fifth engagement portions 21 provided in the first connection portions 14; four placement portions 22 provided at corners on the first surface 12A of the case main body 12; first positioning portions 57 provided at respective top parts of the joint portions 18; second positioning portions 59 provided at corner portions on the second surface 12B of the case main body 12; a third positioning portion 63 provided at a substantially center part on the second surface 12B of the case main body 12; fourth positioning portions 64 provided at respective middle parts in a length direction of the first side-wall portions 16 and the second side-wall portions 17; fifth positioning portions 68 provided at the outer edge portion on the second surface 12B of the case main body 12; and sixth positioning portions 71 provided on the respective placement portions 22. Each of the components of the display case 11 is made of, for example, a synthetic resin material. The first connection portions 14, the second connection portions 15, the first side-wall portions 16, the second side-wall portions 17, the joint portions 18, and the placement portions 22 are included in a concept of the frame body 10.

Figure 6:
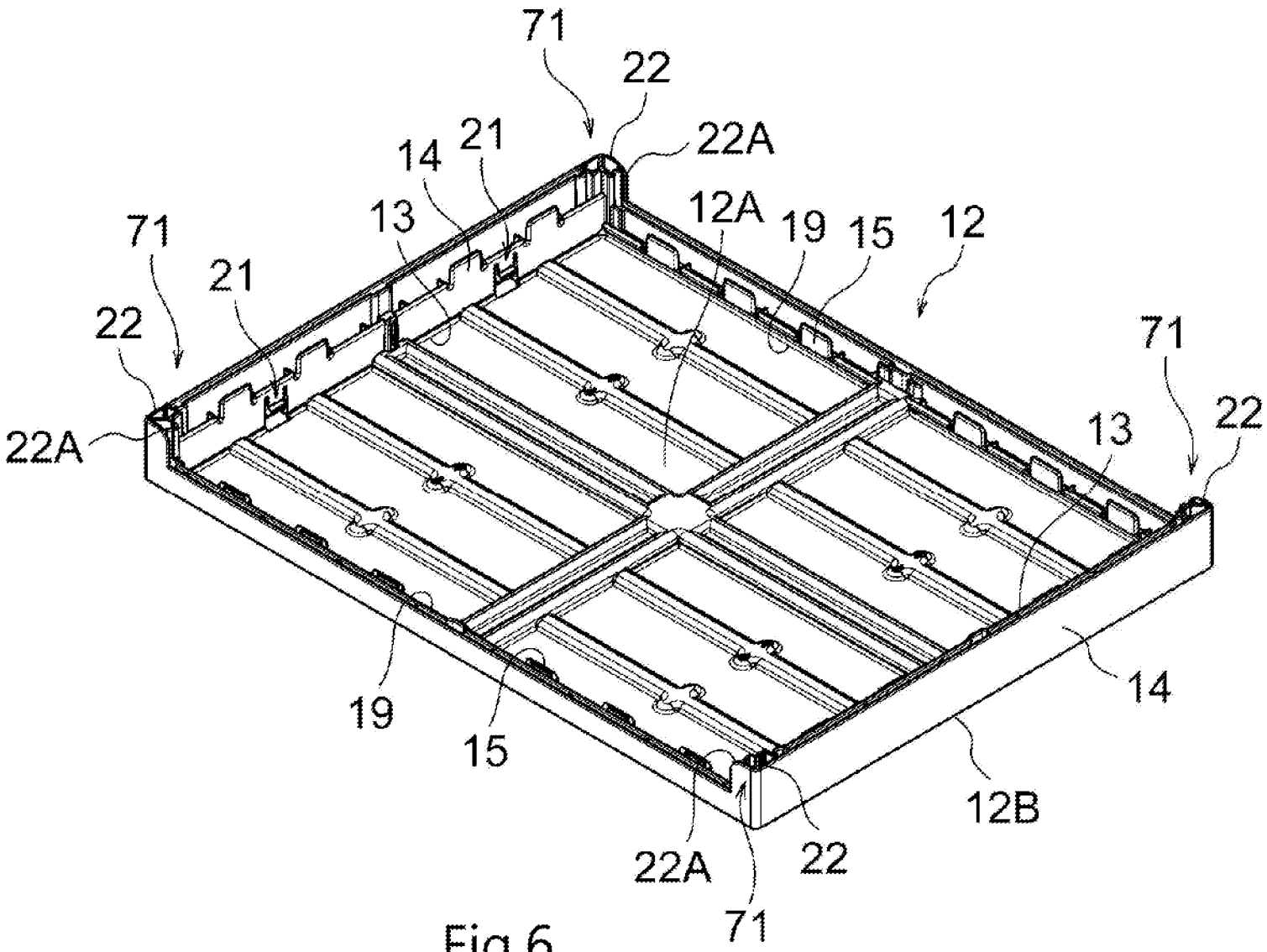
FIG. 6 is a perspective view illustrating a case main body of the display case illustrated in FIG. 1 as viewed from a first surface side.
Figure 7:
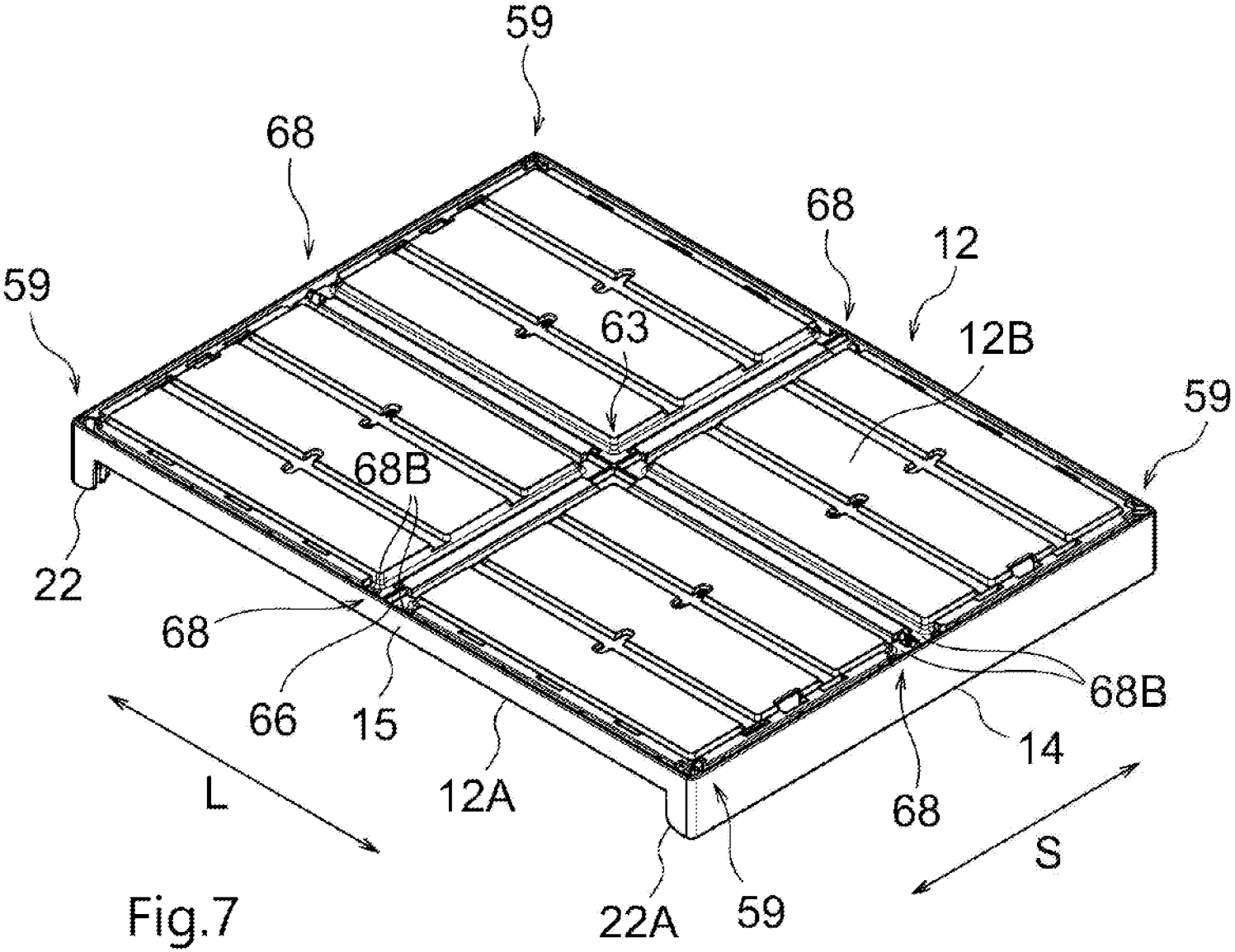
FIG. 7 is a perspective view illustrating the case main body illustrated in FIG. 3 as viewed from a second surface side.

As illustrated in FIG. 6 and FIG. 7, the paired first connection portions 14 and the paired second connection portions 15 rise from the first surface 12A. The first connection portions 14 and the second connection portions 15 form a frame shape rising from the first surface 12A. The first connection portions 14 are formed in the same form. The second connection portions 15 are also formed in the same form.

Figure 5:
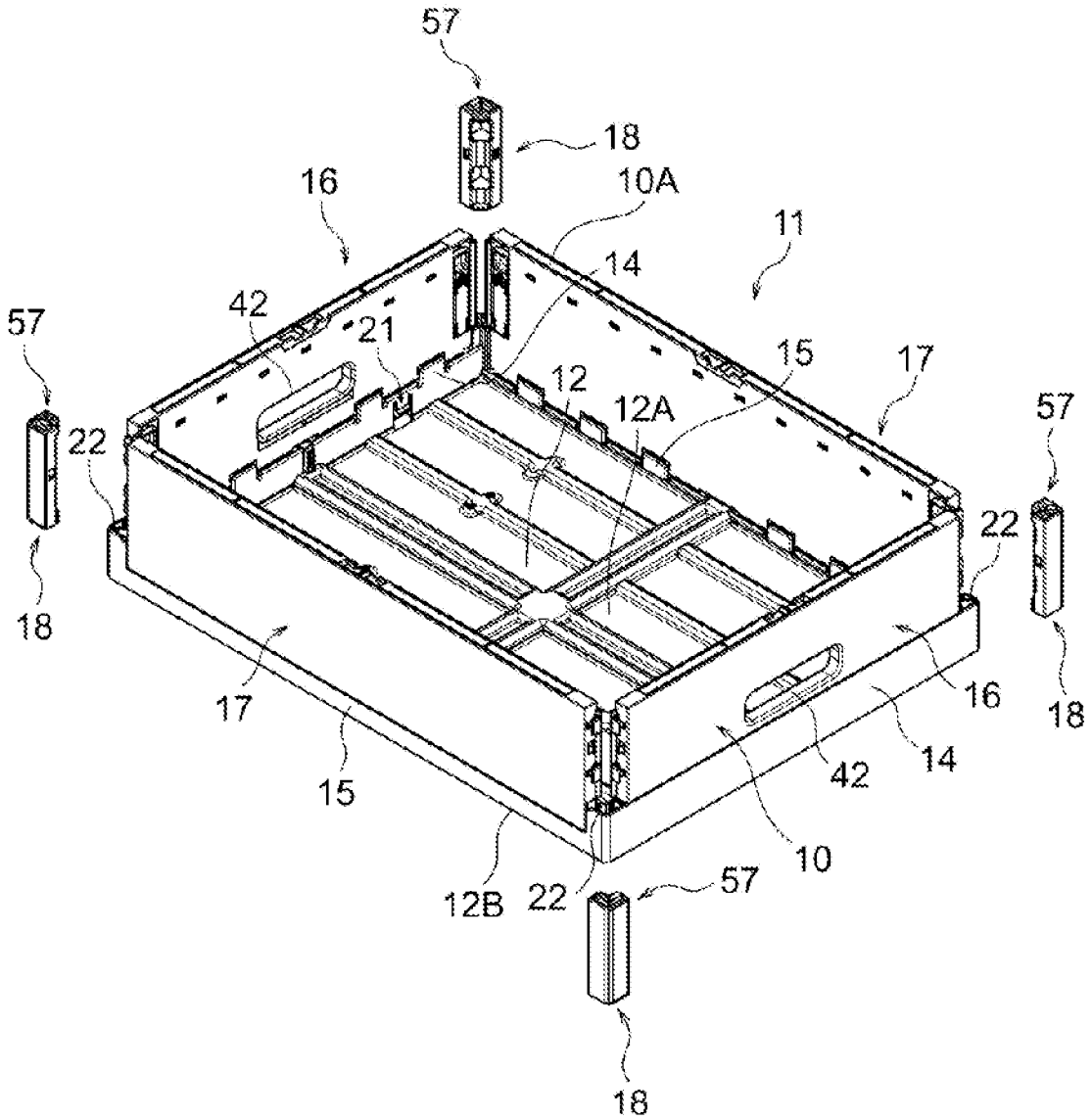
FIG. 5 is a perspective view illustrating a state where joint portions are detached from the display case illustrated in FIG. 1.

As illustrated in FIG. 5, each of the paired second connection portions 15 is formed in a groove shape into which second shaft portions 23 of the corresponding second side-wall portion 17 are fitted. Each of the second shaft portions 23 of the second side-wall portions 17 has a substantially columnar shape, and partially includes a protrusion 23A. The protrusions 23A engage with respective projections 24 of the second connection portions 15. The second shaft portions 23 of the second side-wall portions 17 are not easily detached from the second connection portions 15 by the projections 24 and the protrusions 23A.

Each of the paired first connection portions 14 has a form similar to the form of each of the second connection portions 15. In other words, each of the first connection portions 14 is formed in a groove shape into which first shaft portions of the corresponding first side-wall portion 16 are fitted. The transverse direction S in which the first connection portions 14 extend is a direction intersecting the longitudinal direction L in which the second connection portions 15 extend. Each of the first connection portions 14 protrudes up to a position farther from the case main body 12 than each of the second connection portions 15.

As illustrated in FIG. 6, each of the four placement portions 22 is provided so as to rise from the first surface 12A, and is formed so as to be continuous with and at the same protrusion height as the corresponding first connection portion 14. The joint portions 18 are placed on the respective placement portions 22. Each of the placement portions 22 has a rounded portion 22A such that a corner portion on a center part side of the case main body 12 has an arc shape. The joint portions 18 placed on the respective placement portions 22 can easily fall down on the second connection portions 15 by virtue of the rounded portions 22A.

Figure 8:
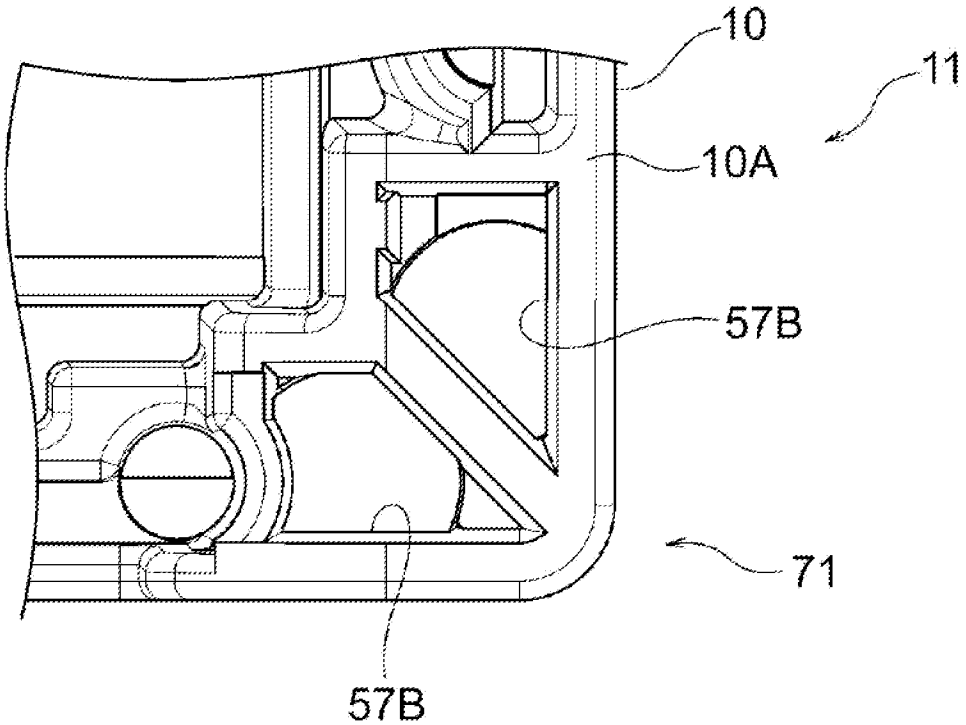
FIG. 8 is a plan view illustrating the case main body illustrated in FIG. 6 as viewed from above.
Figure 9:
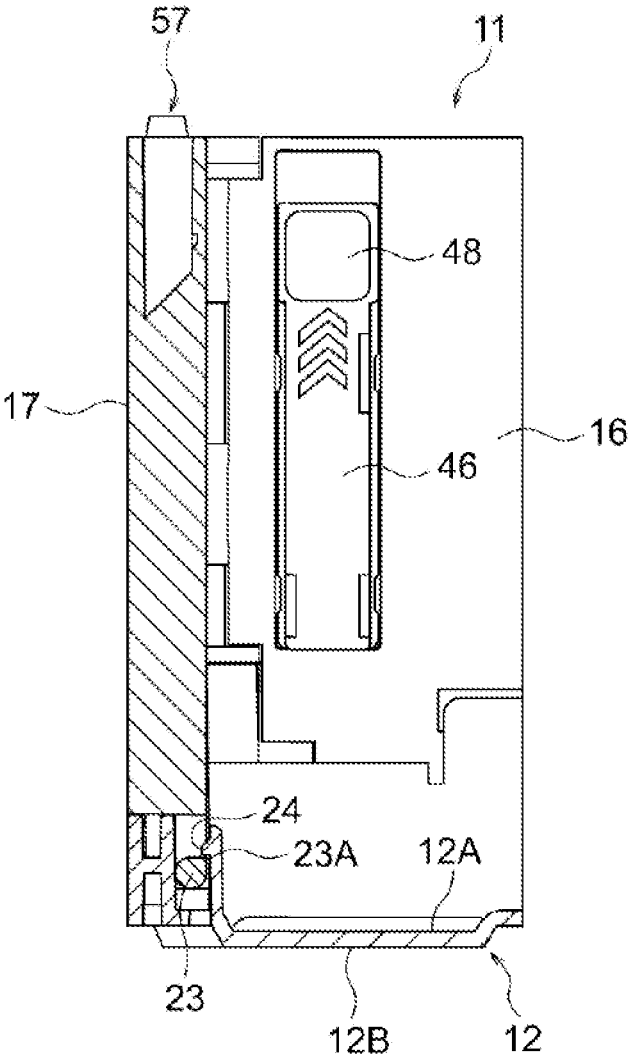
FIG. 9 is a cross-sectional view taken along a position of line F9-F9 illustrated in FIG. 1.

As illustrated in FIG. 8, each of the placement portions 22 includes the sixth positioning portion 71. Each of the sixth positioning portions 71 includes paired concave portions 57B (seventh concave portions). The concave portions 57B have shapes complementally to shapes of convex portions 57A of each of the first positioning portions 57 described below. A convex portion 57A of each of the first positioning portions 57 described below or a convex portion 59A of each of the second positioning portions 59 is inserted into any of the paired concave portions 57B, which makes it possible to stack the display cases 11.

Figure 12:
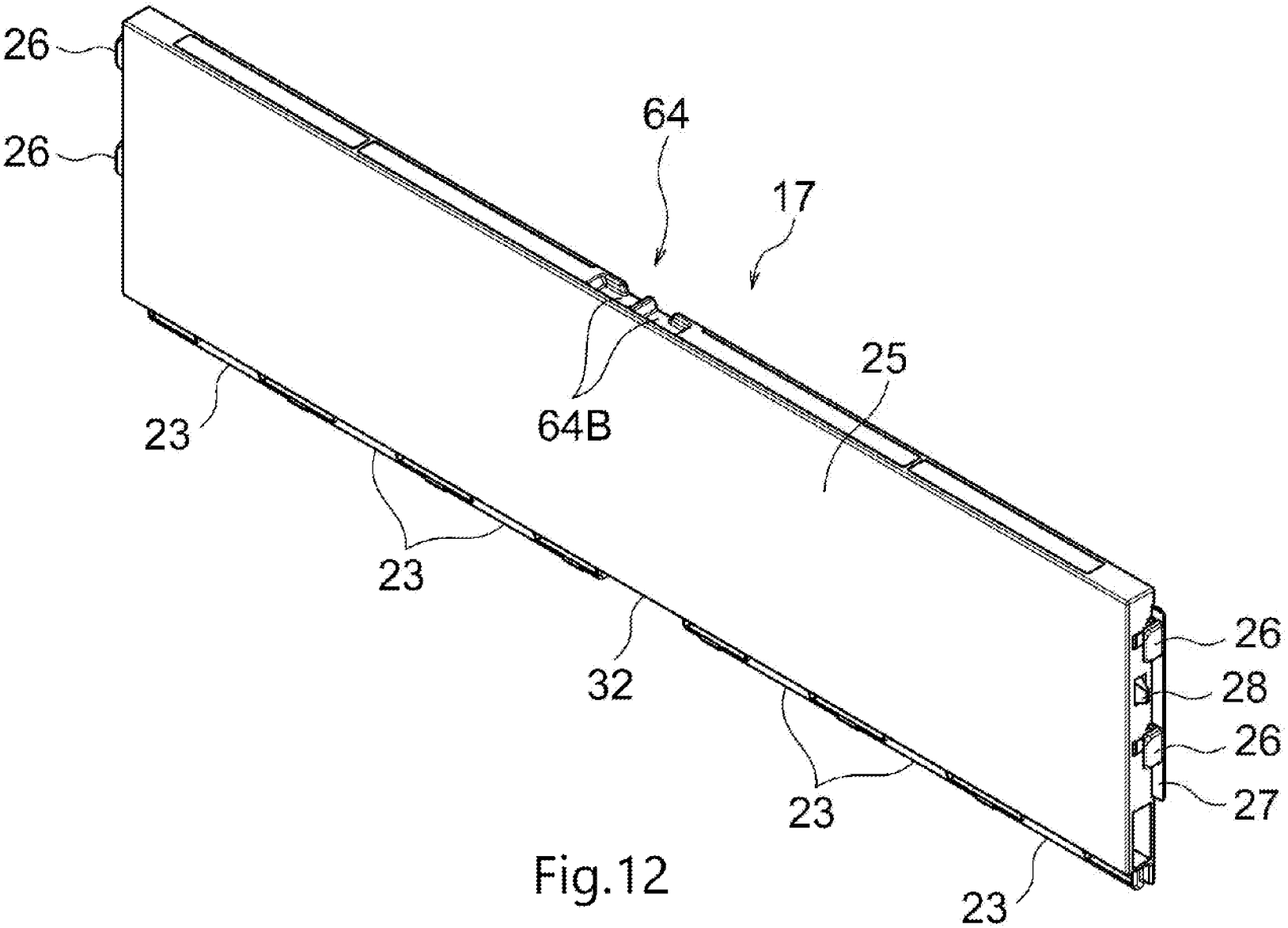
FIG. 12 is a perspective view illustrating a second side-wall portion of the display case illustrated in FIG. 1 as viewed from outside.
Figure 13:
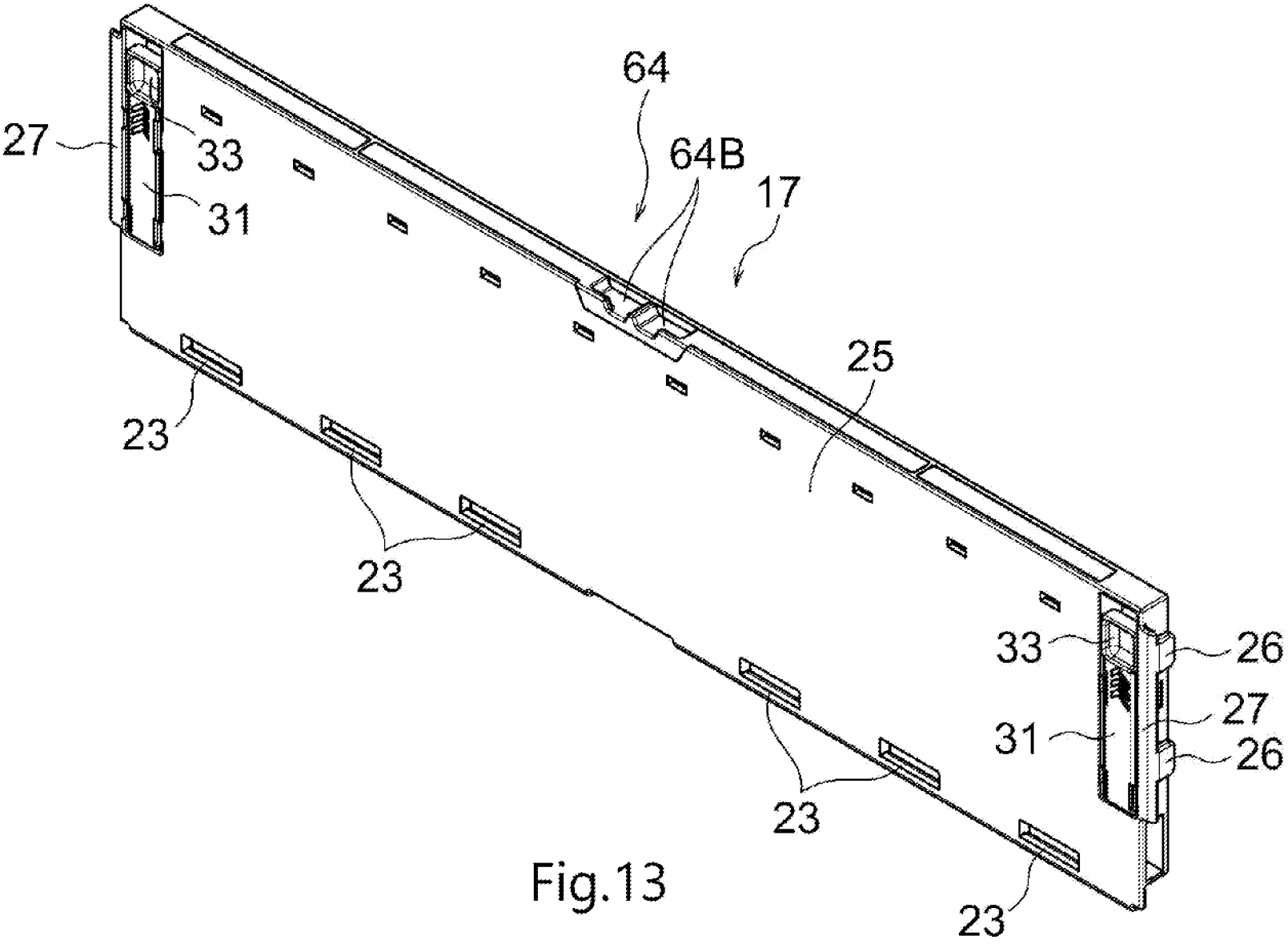
FIG. 13 is a perspective view illustrating the second side-wall portion illustrated in FIG. 12 as viewed from inside.

As illustrated in FIG. 12 and FIG. 13, the paired second side-wall portions 17 are formed in the same form. The second side-wall portions 17 extend along the longitudinal direction L. Each second side-wall portion 17 includes: a second side-wall portion main body 25 having a flat plate shape; upper and lower paired second engagement portions 26 provided on each of side surfaces of the second side-wall portion main body 25; second reinforcing plates 27 each having a flat plate shape and reinforcing the paired second engagement portions 26 so as to couple the paired second engagement portions 26; second latches 28 each provided between the paired second engagement portions 26; second levers 31 retracting the respective second latches 28; and the second shaft portions 23 and a lower ridgeline 32 provided on a lower end of the second side-wall portion main body 25. Each second side-wall portion 17 is turnable between a third position P3 where the second side-wall portion 17 stands up from the case main body 12 and a fourth position P4 where the second side-wall portion 17 falls down on the case main body 12, around the corresponding second connection portion 15 (second shaft portions 23). The lower ridgeline 32 extends in the longitudinal direction L. The lower ridgeline 32 is in contact with the corresponding second connection portion 15 when the second side-wall portion 17 is at the third position P1, and is separated from the case main body 12 when the second side-wall portion 17 is at a second position P2.

Figure 15:
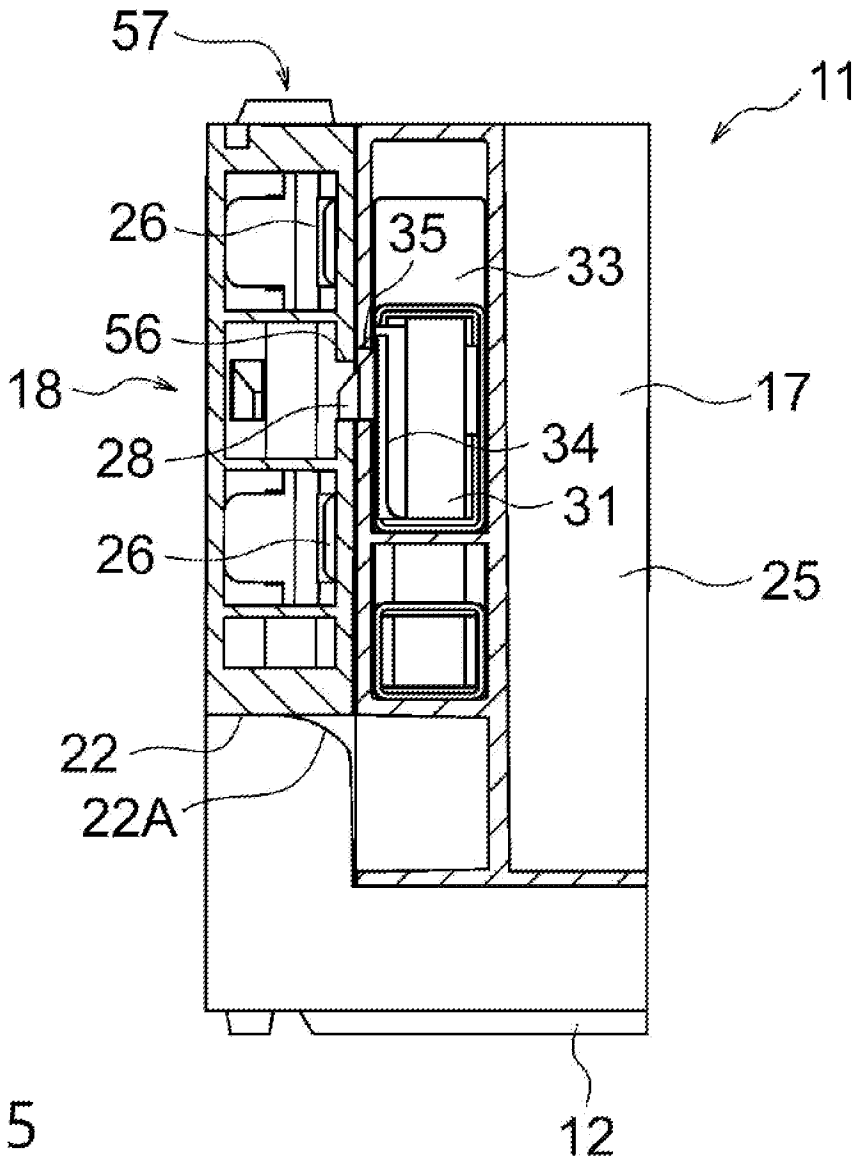
FIG. 15 is a cross-sectional view taken along a position of line F15-F15 of the display case illustrated in FIG. 1.
Figure 16:
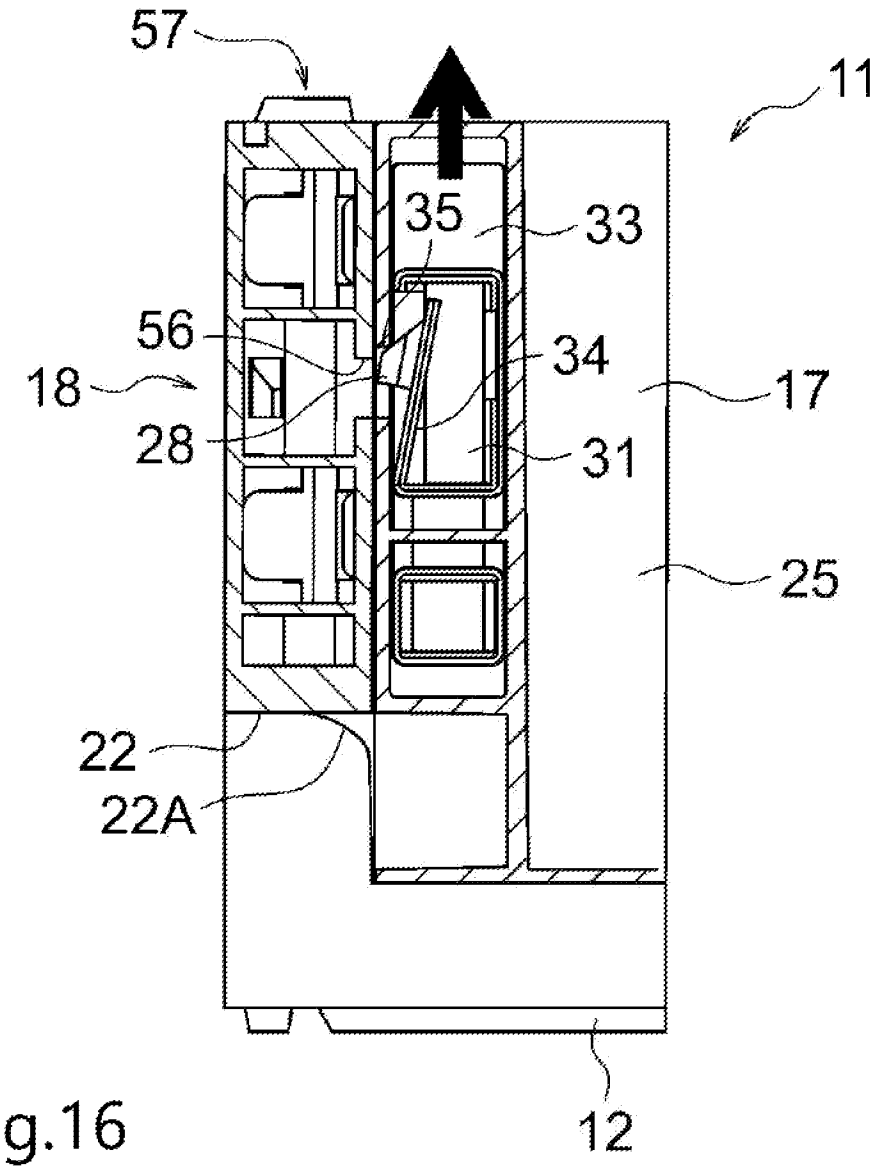
FIG. 16 is a cross-sectional view illustrating a state where, in the display case illustrated in FIG. 15, a second lever is pulled up in an arrow direction, to disengage a second latch from a second hole portion.

Each of the second engagement portions 26 is formed in a hook shape. Front ends of the second engagement portions 26 extend in a thickness direction of the second side-wall portion 17. The second engagement portions 26 are integrally formed with the corresponding second reinforcing plates 27. As illustrated in FIG. 13, FIG. 15, and FIG. 16, each of the second levers 31 includes a second finger hook portion 33, and a second supporting portion 34 supporting the second latch 28 in a cantilever state. The second levers 31 are each integrally made of a synthetic resin material.

The second levers 31 are housed in respective concave portions of the second side-wall portion main body 25 so as to be slidable to the second side-wall portion main body 25. As illustrated in FIG. 15 and FIG. 16, the second latches 28 are integrally formed with the respective second levers 31, and are each formed in a trapezoidal shape. The second latches 28 can be retracted and protrude from respective opening portions 35. As illustrated by an arrow in FIG. 16, when a user pulls the second levers 31 upward through the respective second finger hook portions 33, the second supporting portions 34 are each bent due to relationship between the opening portion 35 and the second latch 28 provided in the second side-wall portion main body 25, thereby retracting the second latches 28 into the second side-wall portion 17. In this state, the user can move the second side-wall portion 17 from the third position P3 to the fourth position P4. In contrast, when the user releases the pulling up of the second levers 31, the second supporting portions 34 are restored to original shapes before being bent. As a result, the second levers 31 are returned to original positions, and the second latches 28 protrude to the outside again. Note that the configuration of the second levers 31 is illustrative, and a configuration in which the second levers 31 are pushed down to retract the respective second latches 28 may be adopted.

To return the second side-wall portion 17 from the fourth position P4 to the third position P3, the second side-wall portion 17 is just moved to the third position P3. At this time, after the second latches 28 are retracted into the second side-wall portion 17 by action of inclined surfaces, the second supporting portions 34 are restored to the original shapes and the second latches 28 accordingly protrude again. As a result, the second latches 28 engage with respective second hole portions 56 of the joint portions 18, and the second side-wall portion 17 is held at the third position P3.

Figure 10:
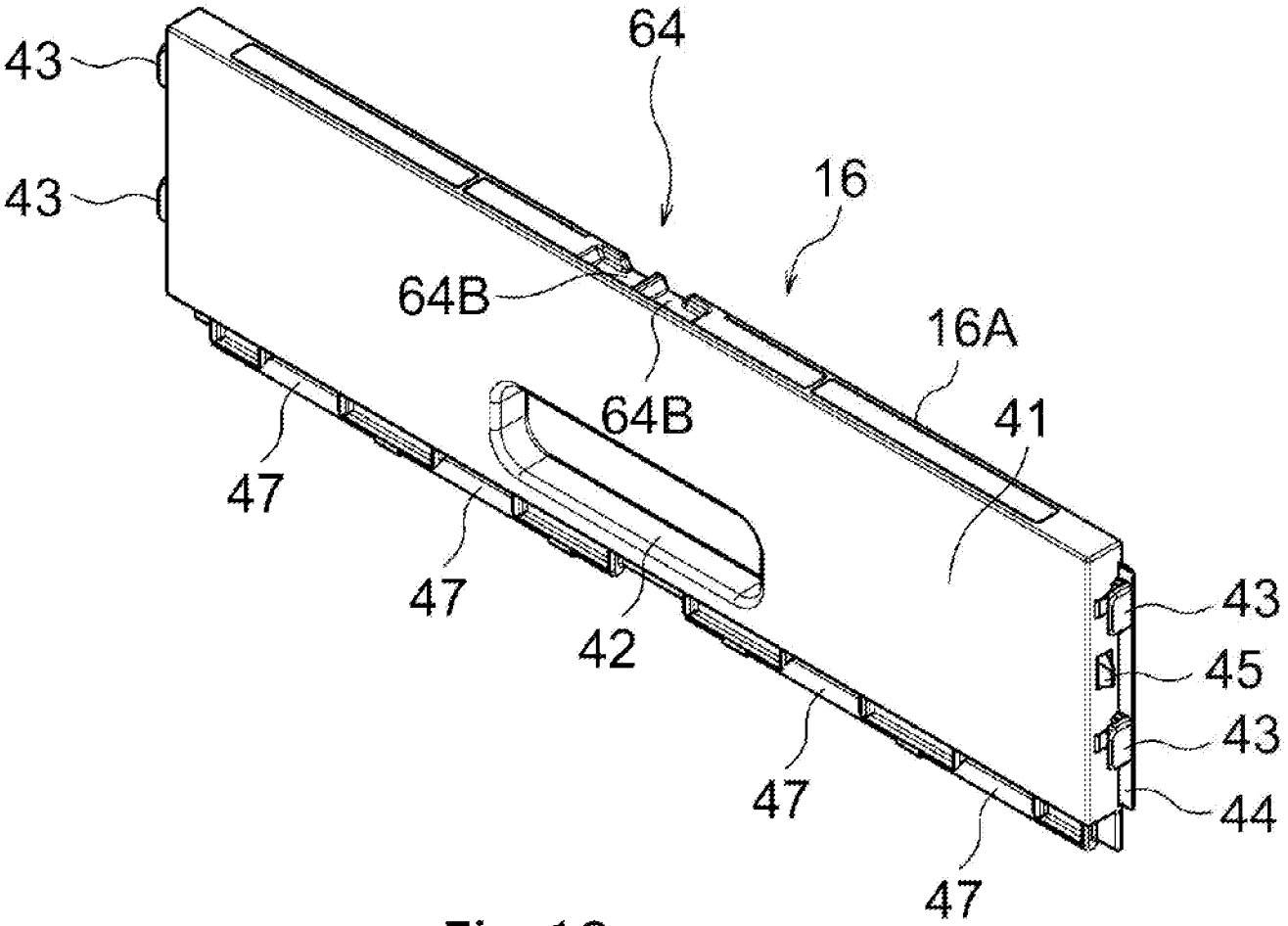
FIG. 10 is a perspective view illustrating a first side-wall portion of the display case illustrated in FIG. 1 as viewed from outside.
Figure 11:
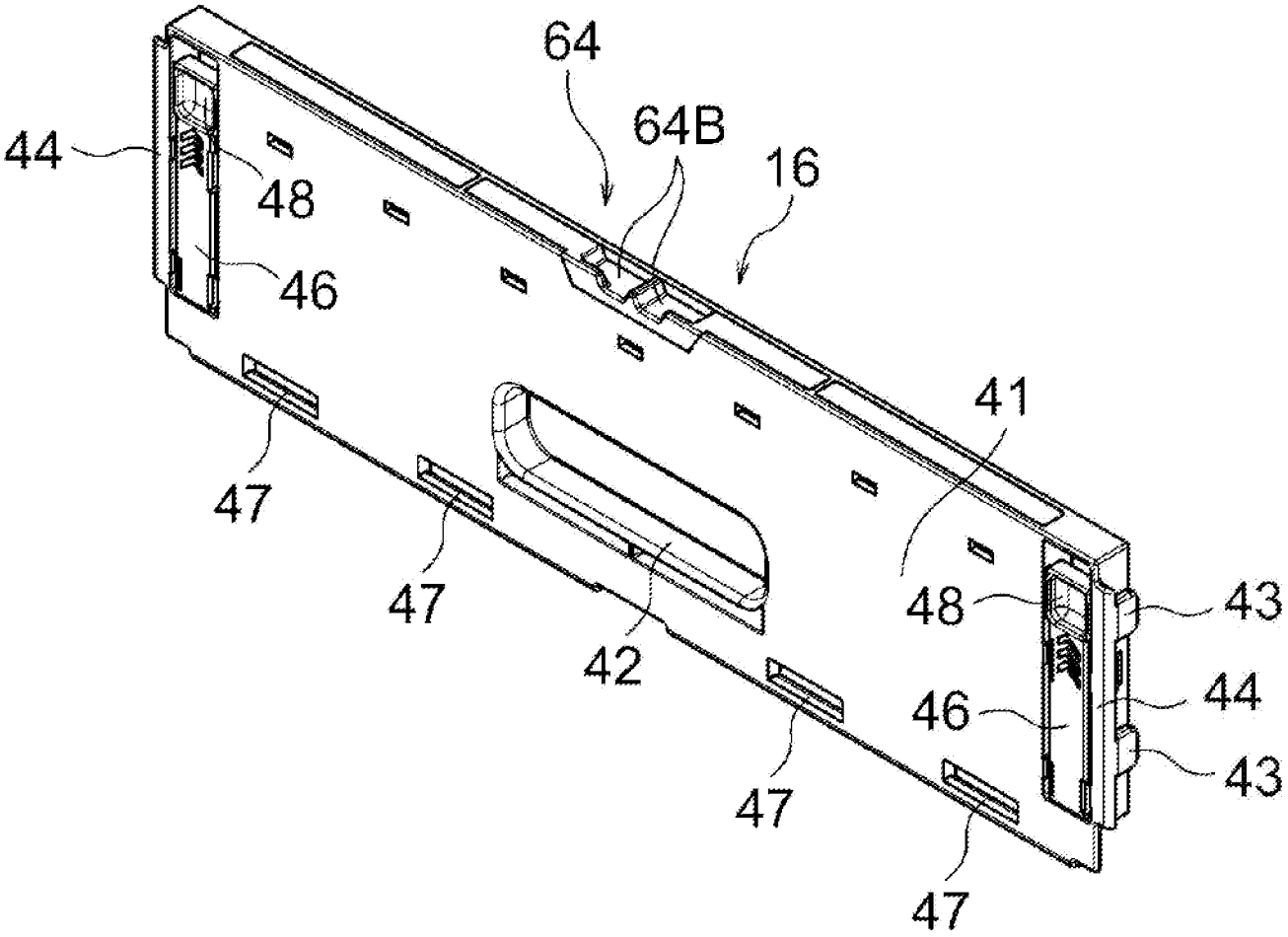
FIG. 11 is a perspective view illustrating the first side-wall portion illustrated in FIG. 10 as viewed from inside.

As illustrated in FIG. 10 and FIG. 11, the paired first side-wall portions 16 are formed in the same form. The first side-wall portions 16 extend along the transverse direction S. The first side-wall portions 16 are different from the second side-wall portions 17 in that each of the first side-wall portions 16 has a length dimension different from a length dimension of each of the second side-wall portions 17, and includes a handle portion 42; however, the other configurations are substantially similar to the configurations of the second side-wall portions 17.

Each first side-wall portion 16 includes: a first side-wall portion main body 41 having a flat plate shape; the handle portion 42 provided at a lower center part of the first side-wall portion main body 41; upper and lower paired first engagement portions 43 provided on each of side surfaces of the first side-wall portion main body 41; first reinforcing plates 44 each reinforcing the paired first engagement portions 43 so as to couple the paired first engagement portions 43; first latches 45 each provided between the paired first engagement portions 43; first levers 46 retracting the respective first latches 45; and first shaft portions 47 provided at a lower end of the first side-wall portion main body 41. Each first side-wall portion 16 is turnable between a first position P1 where the first side-wall portion 16 stands up from the case main body 12 and the second position P2 where the first side-wall portion 16 falls down on the case main body 12, around the corresponding first connection portion 14 (first shaft portions 47).

Each of the first engagement portions 43 is formed in a hook shape. Front ends of the first engagement portions 43 extend in a thickness direction of the first side-wall portion 16. The first engagement portions 43 are integrally formed with the corresponding first reinforcing plates 44. Each of the first levers 46 includes a first finger hook portion 48, and a first supporting portion supporting the first latch 45 in a cantilever state. The first levers 46 are each integrally made of a synthetic resin material.

The first levers 46 are housed in respective concave portions of the first side-wall portion main body 41 so as to be slidable to the first side-wall portion main body 41. The first latches 45 are integrally formed with the respective first levers 46, and are each formed in a trapezoidal shape. The first latches 45 can be retracted and protrude from the respective opening portions 35. When the user pulls the first levers 46 upward through the respective first finger hook portions 48, the first supporting portions similar to the second supporting portions 34 are bent due to relationship between the opening portion 35 and the first latch 45, thereby retracting the first latches 45 into the first side-wall portion 16. In this state, the user can move the first side-wall portion 16 from the first position P1 to the second position P2. In contrast, when the user releases the pulling up of the first levers 46, the first supporting portions are restored to original shapes before being bent. As a result, the first latches 45 protrude to the outside again. Note that the configuration of the first levers 46 is illustrative, and a configuration in which the first levers 46 are pushed down to retract the second latches 28 may be adopted.

To return the first side-wall portion 16 from the second position P2 to the first position P1, the first side-wall portion 16 is just moved to the first position P1. At this time, after the first latches 45 are retracted into the first side-wall portion 16 by action of inclined surfaces, the first supporting portions are restored to the original shapes and the first latches 45 accordingly protrude again. As a result, the first latches 45 engage with respective first hole portions 55 of the joint portions 18, and the first side-wall portion 16 is held at the first position P1.

Figure 14:
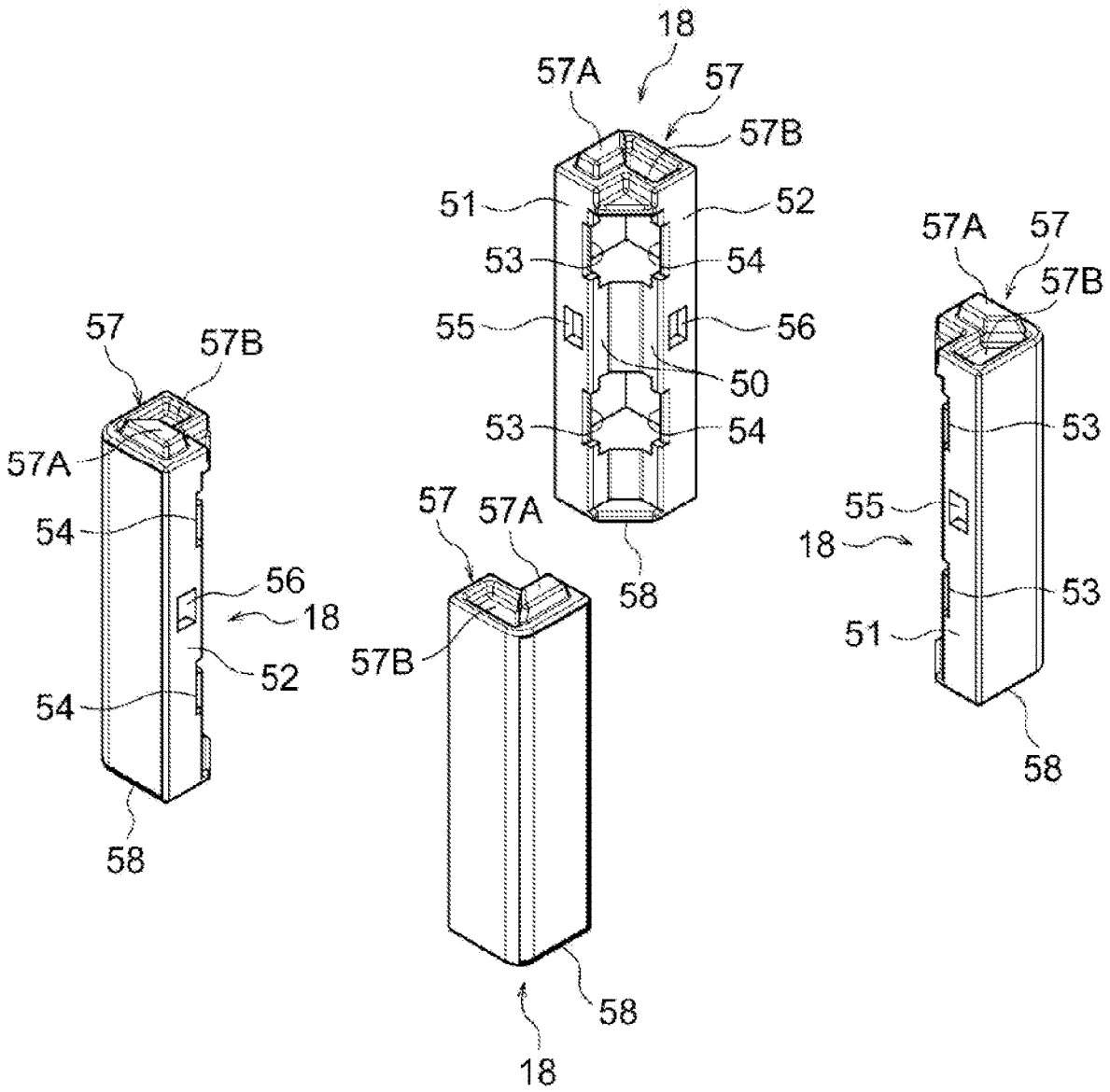
FIG. 14 is a perspective view illustrating four joint portions in total of the display case illustrated in FIG. 1.

As illustrated in FIG. 14, the four joint portions 18 are formed in the same form. The four joint portions 18 in total are placed on the four placement portions one-on-one. The joint portions 18 are provided at the corners of the case main body 12. Each of the joint portions 18 has an "L" shape as viewed from above, and is formed in a columnar shape extending in a direction intersecting the first surface 12A of the case main body 12. Each joint portion 18 includes: paired inner surfaces 50; a first wall 51 facing the adjacent first side-wall portion 16; a second wall 52 facing the adjacent second side-wall portion 17; third engagement portions 53 engaging with the first engagement portions 43 of the adjacent first side-wall portion 16; fourth engagement portions 54 engaging with the second engagement portions 26 of the adjacent second side-wall portion 17; the first hole portion 55 provided in the first wall 51 and engaging with the first latch 45 of the adjacent first side-wall portion 16; the second hole portion 56 provided in the second wall 52 and engaging with the second latch 28 of the adjacent second side-wall portion 17; the first positioning portion 57 provided at a top part; and a flat surface 58 provided on a bottom part.

The third engagement portions 53 are formed in hole shapes into which the respective first engagement portions 43 each having a hook shape are inserted. The third engagement portions 53 can engage with and disengage from the first engagement portions 43 of the turning first side-wall portion 16. The fourth engagement portions 54 are formed in hole shapes into which the respective second engagement portions 26 each having a hook shape are inserted. The fourth engagement portions 54 can engage with and disengage from the second engagement portions 26 of the turning second side-wall portion 17. In the present embodiment, each of the third engagement portions 53 and the corresponding fourth engagement portion 54 are formed as an integrated cavity.

The first hole portion 55 is formed as a through hole penetrating through the first wall 51. The second hole portion 56 is formed as a through hole penetrating through the second wall 52. Note that, in the present embodiment, the first latches 45 and the first levers 46 are provided in each of the first side-wall portions 16, and the first hole portion 55 is provided in each of the joint portions 18; however, the arrangement is not limited thereto. The first latch 45 and the first lever 46 may be provided in each of the joint portions 18, and the first hole portions 55 may be provided in each of the first side-wall portions 16.

Likewise, in the present embodiment, the second latches 28 and the second levers 31 are provided in each of the second side-wall portions 17, and the second hole portion 56 is provided in each of the joint portions 18; however, the arrangement is not limited thereto. The second latch 28 and the second lever 31 may be provided in each of the joint portions 18, and the second hole portions 56 may be provided in each of the second side-wall portions 17.

Figure 2:
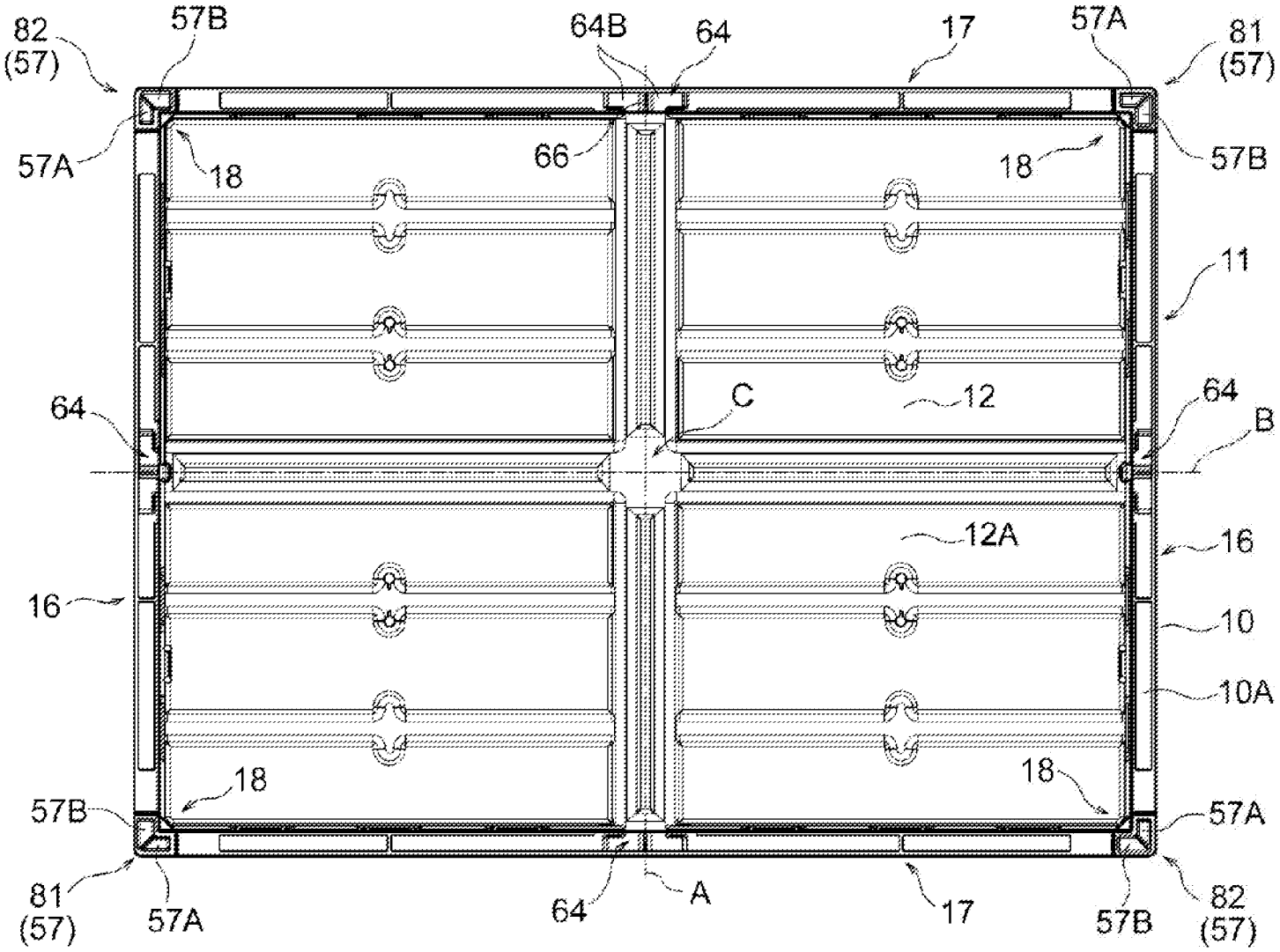
FIG. 2 is a plan view illustrating the display case illustrated in FIG. 1 as viewed from above.

As illustrated in FIG. 1, it can be paraphrased that the first positioning portions 57 are provided on the top surface 10A of the frame body 10. As illustrated in FIG. 14, each of the first positioning portions 57 includes the convex portion 57A (first convex portion) and the concave portion 57B (first concave portion) provided adjacently to the convex portion 57A. As illustrated in FIG. 2, each of the convex portions 57A is formed as a trapezoidal projection. Each of the concave portions 57B is formed as a trapezoidal recess. Each of the first positioning portions 57 has an "L" shape as a whole as viewed from above. In other words, a direction in which each of the convex portion 57A extends is orthogonal to a direction in which the adjacent concave portion 57B extends.

In the present embodiment, for convenience, a lower left corner portion in FIG. 2 is defined as a first corner portion 81 of the top surface 10A. A lower right corner portion and an upper left corner portion in FIG. 2 are defined as second corner portions 82 on the top surface 10A, adjacent to the first corner portion 81. Likewise, when the lower right corner portion in FIG. 2 is defined as the first corner portion 81 of the top surface 10A, the lower right corner portion and the upper left corner portion in FIG. 2 are defined as the second corner portions 82 of the top surface 10A, adjacent to the first corner portion 81. Note that the first corner portions 81 and the second corner portions 82 are distinguished for convenience, and relationship therebetween may be reversed.

Each of the first corner portions 81 is provided with the convex portion 57A (first convex portion). Each of the second corner portions 82 is provided with the convex portion 57A (second convex portion). The convex portion 57A (second convex portion) of each of the second corner portions 82 has a shape equivalent to a shape of the convex portion 57A (first convex portion) of each of the first corner portions 81, but is disposed in a direction rotated by 90 degrees around a center part C of the case main body 12.

Each of the first corner portions 81 is provided with the concave portion 57B (first concave portion). Each of the second corner portions 82 is provided with the concave portion 57B (second concave portion). The concave portion 57B (second concave portion) of each of the second corner portions 82 has a shape equivalent to a shape of the concave portion 57B (first convex portion) of each of the first corner portions 81, but is disposed in a direction rotated by 90 degrees around the center part C of the case main body 12.

The concave portion 57B (first concave portion) of each of the first corner portions 81 has a shape complementary to a shape of the convex portion 57A (first convex portion) of each of the first corner portions 81. Likewise, the concave portion 57B (second concave portion) of each of the second corner portions 82 has a shape complementary to a shape of the convex portion 57A (second convex portion) of each of the second corner portions 82.

The concave portions 57B (second concave portions) of the second corner portions 82 are bilaterally symmetrical to the convex portions 57A (first convex portions) of the first corner portions 81. In other words, based on reference lines A and B passing through the center part C of the case main body 12, the concave portions 57B (second concave portions) of the second corner portions 82 are line symmetrical to the convex portions 57A (first convex portions) of the first corner portions 81. The concave portions 57B (second concave portions) of the second corner portions 82 have shapes complementary to shapes of the convex portions 57A (first convex portions) of the first corner portions 81.

The convex portions 57A (second convex portions) of the second corner portions 82 are bilaterally symmetrical to the concave portions 57B (first concave portions) of the first corner portions 81. In other words, based on the reference lines A and B passing through the center part C of the case main body 12, the convex portions 57A (second convex portions) of the second corner portions 82 are line symmetrical to the concave portions 57B (first concave portions) of the first corner portions 81. The convex portions 57A (second convex portions) of the second corner portions 82 have shapes complementary to shapes of the concave portions 57B (first concave portions) of the first corner portions 81.

Figure 22:
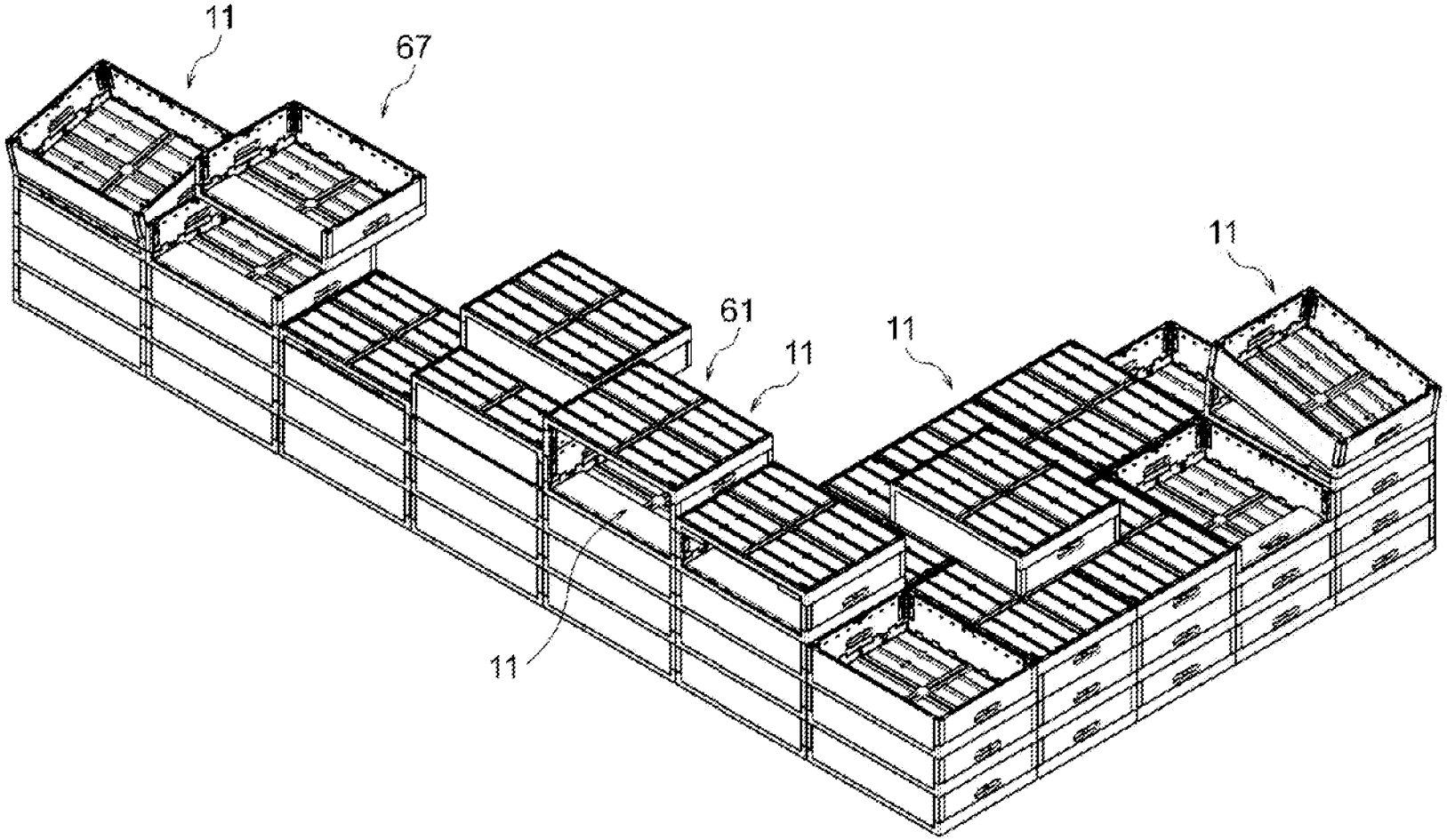
FIG. 22 is a perspective view illustrating display cases in a plurality of use modes including a first special use mode 61.

Thus, according to the display case 11 of the present embodiment, in a case where the display case 11 that is upside down to direct the frame body 10 downward is stacked on the display case 11 that is installed to direct the frame body 10 upward, the convex portions 57A (first convex portions) of the first corner portions 81 are inserted into the concave portions 57B (second concave portions) of the second corner portions 82, and the convex portions 57A (second convex portions) of the second corner portions 82 are inserted into the concave portions 57B (first concave portions) of the first corner portions 81 (see special use mode 61 in FIG. 22).

Figure 3:
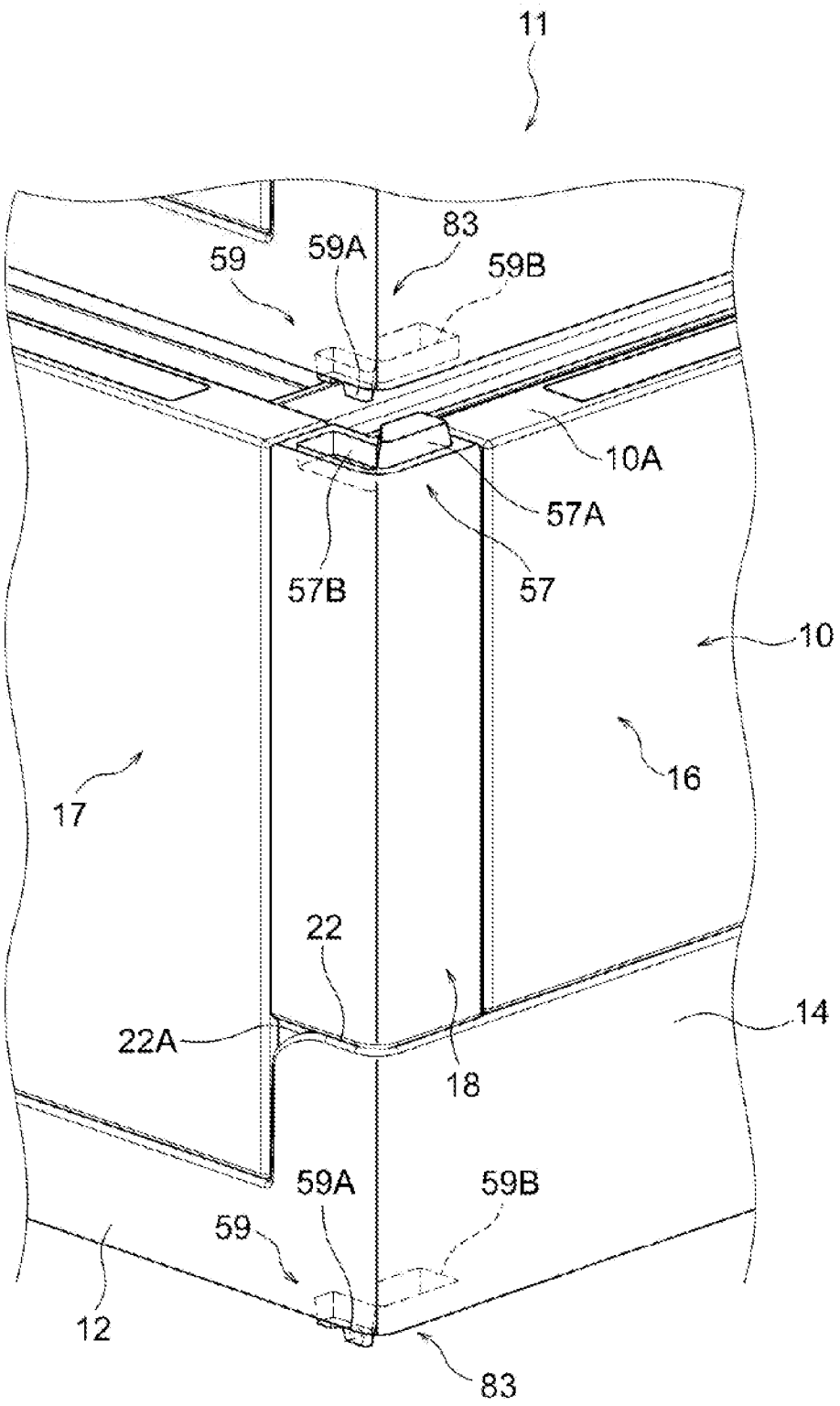
FIG. 3 is a perspective view illustrating a state where the display case is staked and installed on the other display case, as viewed from obliquely above.
Figure 4:
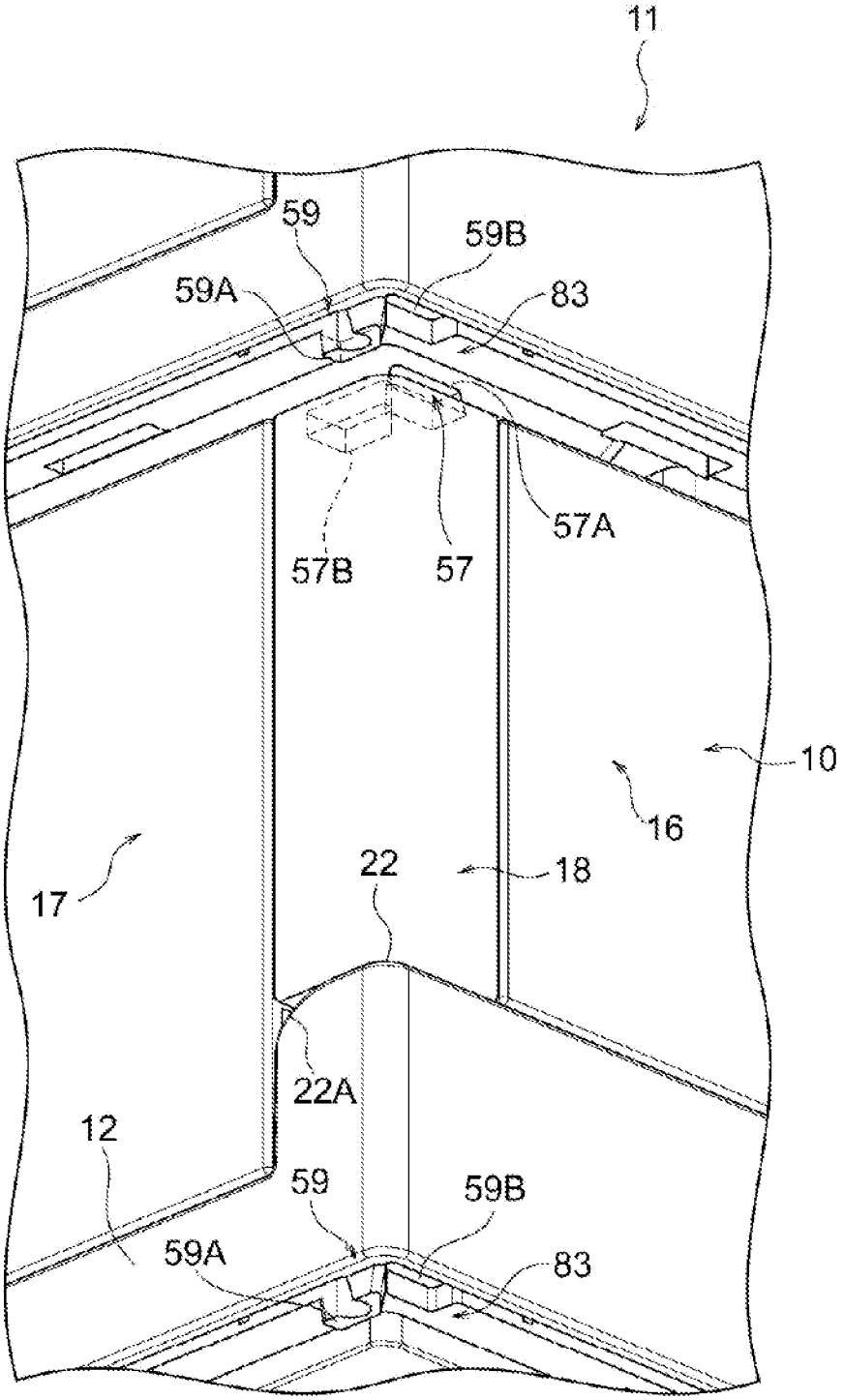
FIG. 4 is a perspective view illustrating the state where the display case is stacked and installed on the other display case, as viewed from obliquely below.

As illustrated in FIG. 3, FIG. 4, and FIG. 7, the display case 11 includes the second positioning portions 59 at respective four corner portions (third corner portions 83) on the second surface 12B. Note that, in the present embodiment, the second positioning portions 59 are provided at the respective four corner portions (third corner portions 83); however, the configuration is not limited thereto, and the second positioning portions 59 may be provided on the respective corner portions of at least one pair at diagonal positions.

Each of the second positioning portions 59 includes a convex portion 59A (third convex portion) and a concave portion 59B (third concave portion) provided adjacently to the convex portion 59A. The concave portions 59B (third concave portions) have shapes complementary to shapes of the convex portions 59A (third convex portions). Each of the convex portions 59A has a shape substantially equivalent to the shape of each of the convex portions 57A on the top surface 10A, and is formed as a trapezoidal projection. Each of the concave portions 59B has a shape substantially equivalent to the shape of each of the concave portions 57B on the top surface 10A, and is formed as a trapezoidal recess. Each of the positioning portions 59 has an "L" shape as a whole. In other words, a direction in which each of the convex portions 59A extends is orthogonal to a direction in which the adjacent concave portion 59B extends.

As illustrated in FIG. 3 and FIG. 4, the concave portions 59B (third concave portions) of the third corner portion 83 on the second surface 12B are provided at positions facing the respective convex portions 57A (first convex portions) of the first corner portions 81. The concave portions 59B (third concave portions) of the third corner portions 83 on the second surface 12B have shapes complementary to the shapes of the convex portions 57A (first convex portions) of the first corner portions 81.

The convex portions 59A (third convex portions) of the third corner portions 83 on the second surface 12B are provided at positions facing the respective concave portions 57B (first concave portions) of the first corner portions 81. The convex portions 59A (third convex portions) of the third corner portions 83 on the second surface 12B have shapes complementary to the shapes of the concave portions 57B (first concave portions) of the first corner portions 81.

Accordingly, when the display case 11 in a normal use state where the first side-wall portions 16 and the second side-wall portions 17 are placed on the upper side is stacked on the other display case 11 in the normal use state where first side-wall portions 16 and the second side-wall portions 17 are placed on the upper side, the first positioning portions 57 and the second positioning portions 59 constitute guides so as to enable the display case 11 to be placed at a correct position.

Further, the concave portion 59B (third concave portion) of one of the third corner portions 83 on the second surface 12B is bilaterally symmetrical to and has a shape complementary to the shape of the convex portion 59A (third convex portion) of the other adjacent third corner portion 83 on the second surface 12B. Likewise, the convex portion 59A (third convex portion) of one of the third corner portions 83 on the second surface 12B is bilaterally symmetrical to and has a shape complementary to the shape of the concave portion 59B (third concave portion) of the other adjacent third corner portion 83 on the second surface 12B. Accordingly, for example, in a case where the display case 11 in the normal use state where the first side-wall portions 16 and the second side-wall portions 17 are placed on the upper side is stacked on the display case 11 in an upside-down state where the first side-wall portions 16 and the second side-wall portions 17 are placed on the lower side, the convex portions 59A (third convex portions) are inserted into the concave portions 59B (third concave portions) to constitute guides so as to enable the display case 11 to be placed at a correct position.

Figure 23:
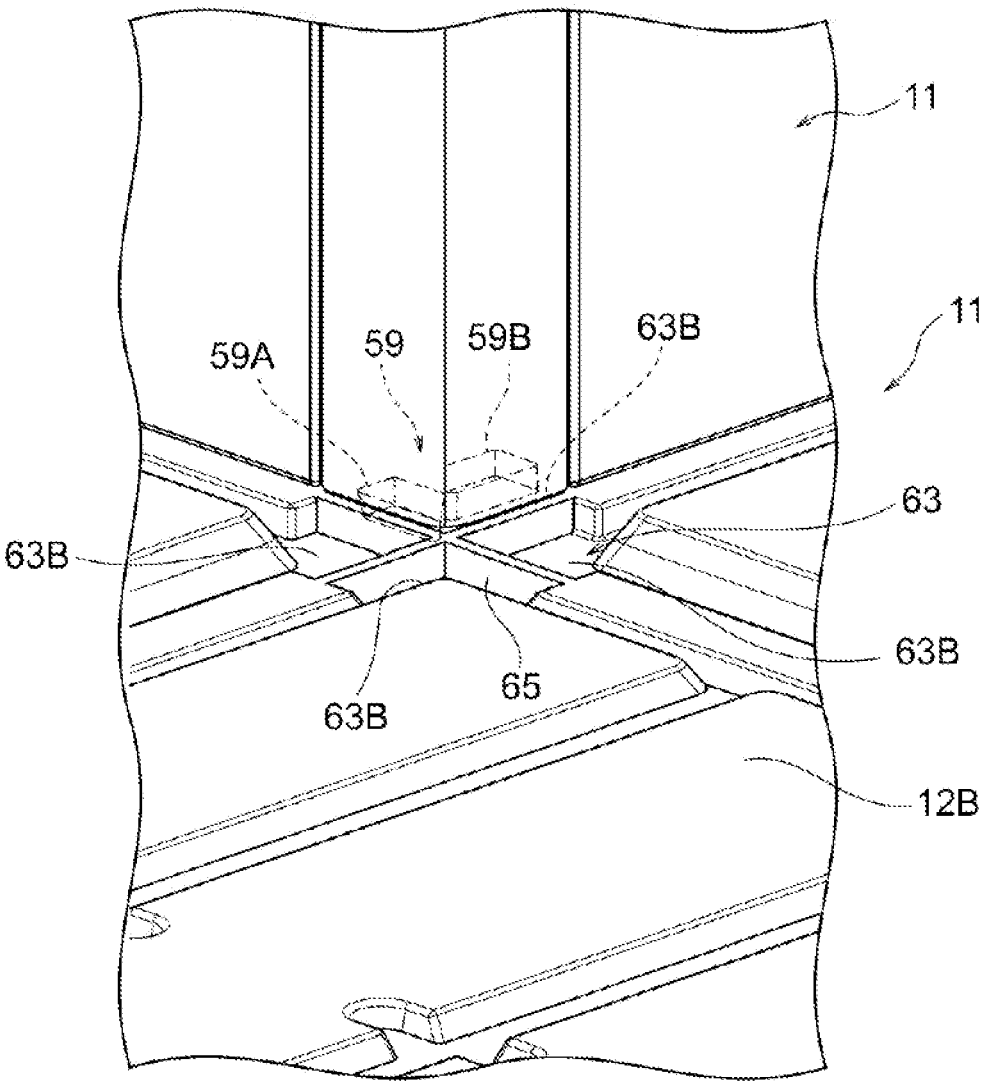
FIG. 23 is a perspective view illustrating a third positioning portion on the second surface of the case main body illustrated in FIG. 7, and a first positioning portion fitted thereto.

As illustrated in FIG. 7 and FIG. 23, the third positioning portion 63 is provided at the substantially center part on the second surface 12B of the case main body 12. The third positioning portion 63 includes four concave portions 63B (fourth concave portions) in total. Each of the concave portions 63B (fourth concave portions) has a shape obtained by forming both of the convex portion 57A and the concave portion 57B of each of the first positioning portions 57 as recesses and combining the convex portion 57A and the concave portion 57B to form an "L" shape as a whole. The convex portions 57A of the first positioning portions 57 and the convex portions 59A of the second positioning portions 59 can be inserted into the concave portions 63B.

Figure 30:
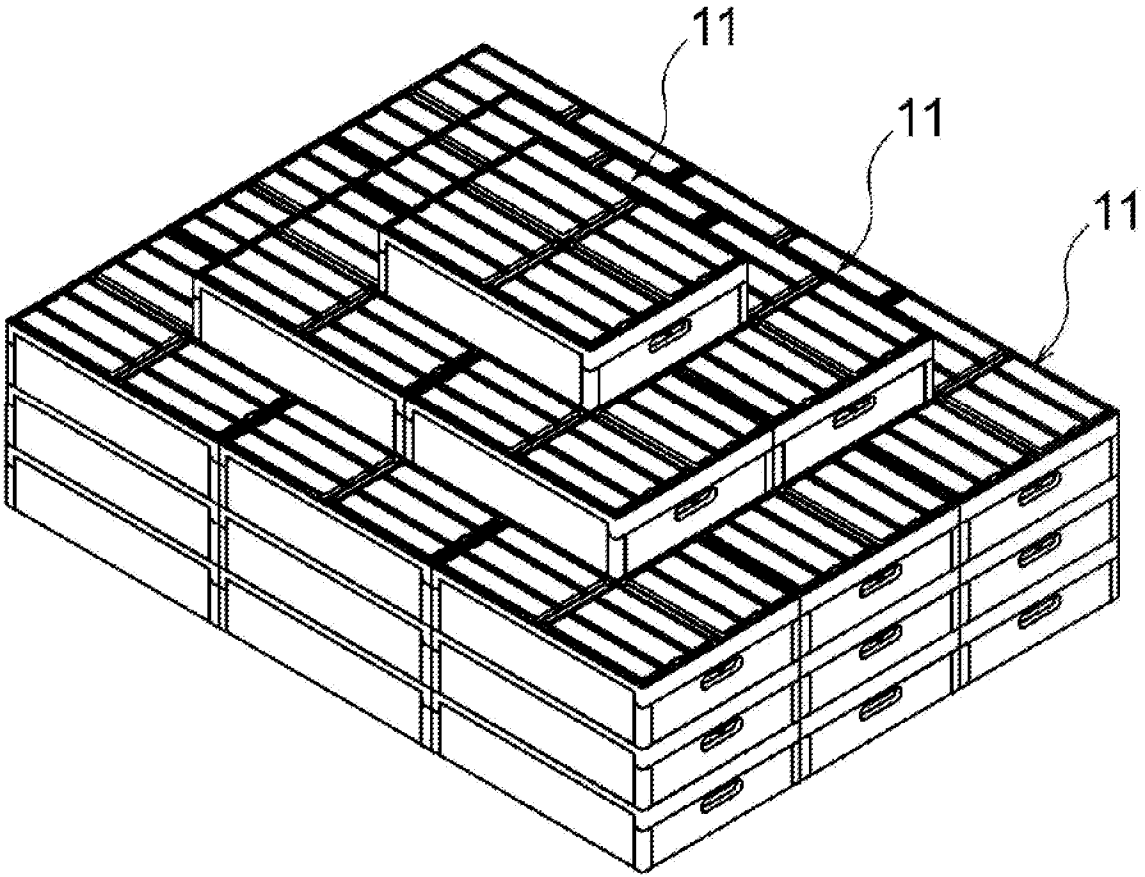
FIG. 30 is a perspective view illustrating display cases in the sixth applicable use mode.

The concave portions 63B are partitioned by a rib portion 65 having a cross shape. When the convex portions 57A of the first positioning portions 57 are inserted into the concave portions 63B of the third positioning portions 63, the display case 11 in the upside-down state where the first side-wall portions 16 and the second side-wall portions 17 are placed on the lower side can be installed on the four display cases 11 each in the upside-down state where the first side-wall portions 16 and the second side-wall portions 17 are placed on the lower side, to realize a display table like a tiered stand, for example, as illustrated in FIG. 30. Note that the present embodiment is illustrative, and the convex portions 57A similar to the first positioning portions 57 can be provided on the third positioning portion 63.

As illustrated in FIG. 1 and FIG. 2, the fourth positioning portions 64 are provided at the respective middle parts in the length direction of the first side-wall portions 16 and at the respective middle parts in the length direction of the second side-wall portions 17. The fourth positioning portions 64 are provided at positions corresponding to the top surface 10A. Each of the fourth positioning portions 64 includes two concave portions 64B (fifth concave portions) in total. Each of the concave portions 64B is formed in a shape complementary to the shape of each of the convex portions 57A of the first positioning portions 57. The concave portions 64B are partitioned by a rib portion 66.

As illustrated in FIG. 7, the fifth positioning portions 68 are provided at the respective middle parts in the longitudinal direction L and the respective middle parts in the transverse direction S of the outer edge portion on the second surface 12B of the case main body 12. Each of the fifth positioning portions 68 includes two concave portions 68B in total. Each of the fifth positioning portions 68 has a shape obtained by forming both of the convex portion 57A and the concave portion 57B of each of the first positioning portions 57 as recesses and combining the convex portion 57A and the concave portion 57B to form an "L" shape as a whole. Each of the concave portions 68B has the form same as each of the concave portions 63B of the third positioning portion 63. The concave portions 64B are partitioned by the rib portion 66. The convex portions 57A of the first positioning portions 57 and the convex portions 59A of the second positioning portions 59 can be inserted into the concave portions 63B. Note that the present embodiment is illustrative, and the convex portion 57A similar to each of the first positioning portions 57 can be provided on each of the fifth positioning portions 68.

Accordingly, as in a second special use mode 67 as illustrated in FIG. 22, when the display case 11 in the normal use state where the first side-wall portions 16 and the second side-wall portions 17 are placed on the upper side is placed on the other display case 11 in the normal use state where the first side-wall portions 16 and the second side-wall portions 17 are placed on the upper side, the display case 11 can be placed on the other display case 11 while the display case 11 on the upper side is displaced by a half of the length of the display case 11 in the transverse direction S from the display case 11 on the lower side. At this time, the convex portions 59A of the second positioning portions 59 of the display case 11 on the upper side are fitted into the concave portions 64B of the fourth positioning portions 64 of the display case 11 on the lower side, and the convex portions 57A of the first positioning portions 57 of the display case on the lower side are fitted into the concave portions 68B of the fifth positioning portions 68 of the display case 11 on the upper side.

Although not illustrated, when the display case 11 in the normal use state where the first side-wall portions 16 and the second side-wall portions 17 are placed on the upper side is placed on the other display case 11 in the normal use state where the first side-wall portions 16 and the second side-wall portions 17 are placed on the upper side, the display case 11 can be placed on the other display case 11 while the display case 11 on the upper side is displaced by a half of the length of the display case 11 in the longitudinal direction L from the display case 11 on the lower side. At this time, the convex portions 59A of the second positioning portions 59 of the display case 11 on the upper side are fitted into the concave portions 64B of the fourth positioning portions 64 of the display case 11 on the lower side, and the convex portions 57A of the first positioning portions 57 of the display case 11 on the lower side are fitted into the concave portions 68B of the fifth positioning portions 68 of the display case 11 on the upper side.

Figure 19:
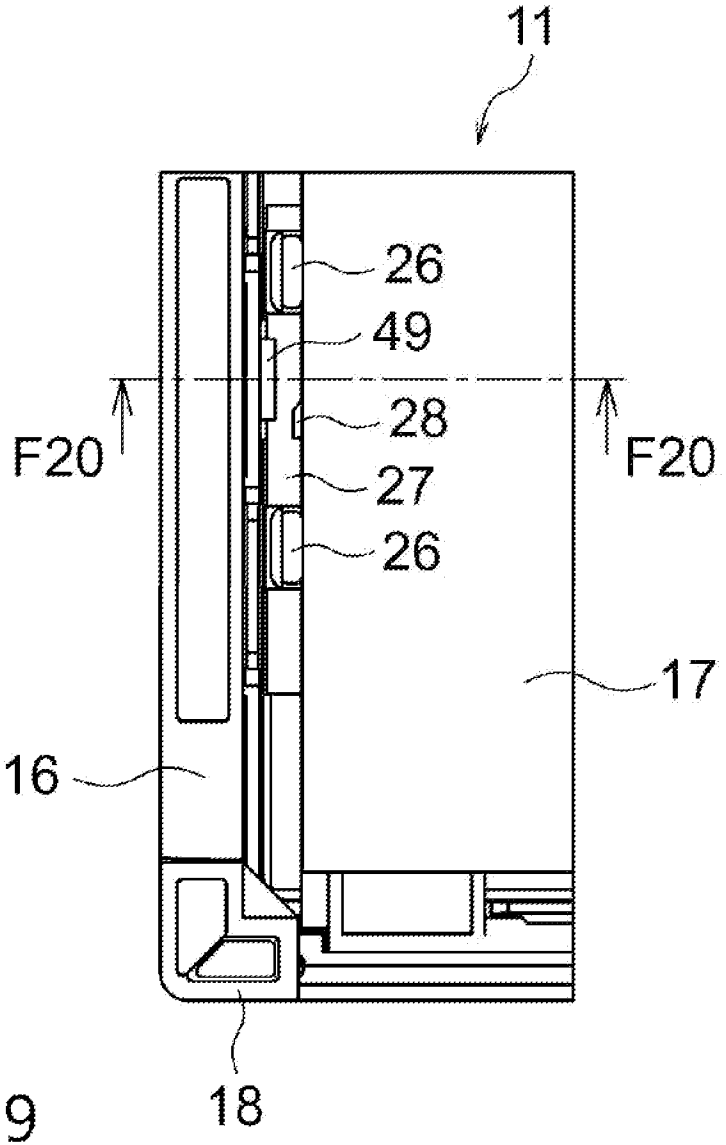
FIG. 19 is a plan view of the display case illustrated in FIG. 17 as viewed from above.
Figure 20:
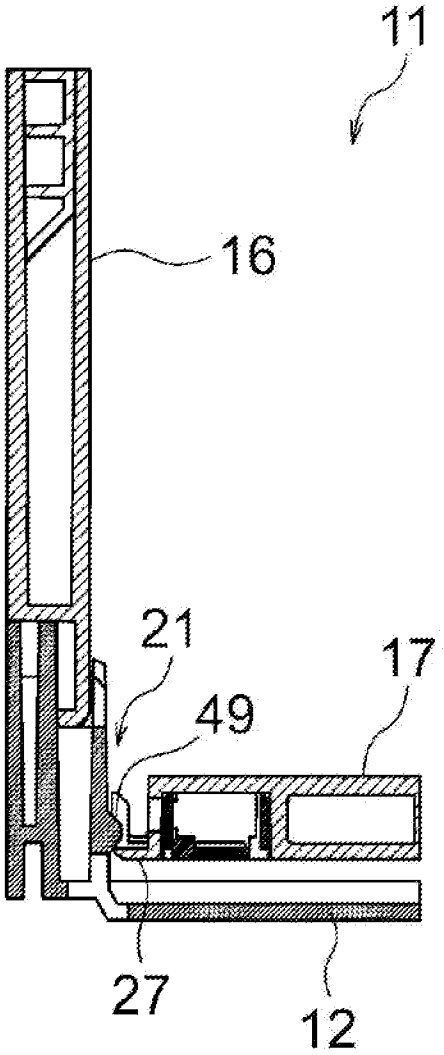
FIG. 20 is a cross-sectional view taken along a position of line F20-F20 of the display case illustrated in FIG. 19.

As illustrated in FIG. 6, the fifth engagement portions 21 are provided at positions close to the case main body 12 (first surface 12A), in the first connection portions 14. As illustrated in FIG. 6, FIG. 19, and FIG. 20, each of the fifth engagement portions 21 is formed in a tongue shape protruding downward, and exerts flexibility at a front end side. Each of the fifth engagement portions 21 includes, at the front end part of the tongue shape, a locking projection 49 to lock the second reinforcing plate 27 of the corresponding side-wall portion 17.

Subsequently, action of the display case 11 according to the present embodiment is described with reference to FIG. 1, FIGS. 15 to 17, and FIGS. 19 to 21.

As illustrated in FIG. 1, in a state where the display case 11 is set up as a box, the user can put commodities in the display case 11 and transport the commodities, or can install the display case 11 storing the commodities in a store to display the commodities. At this time, the user can carry the display case 11 by using the handle portions 42.

Figure 17:
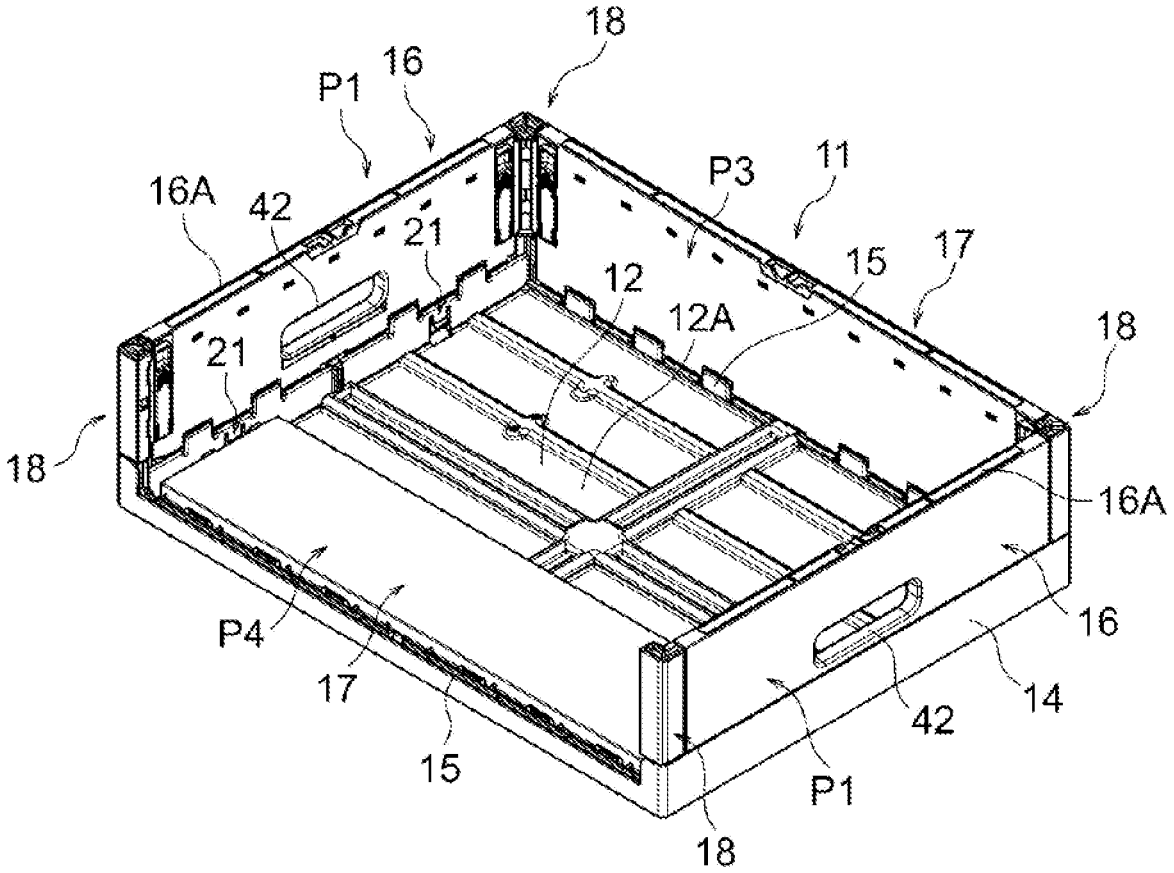
FIG. 17 is a perspective view illustrating a state after one of paired second side-wall portions is moved to a fourth position in the display case illustrated in FIG. 1.

As illustrated in FIG. 17, commodities can be displayed while only one of the paired second side-wall portions 17 of the display case 11 is moved from the third position P3 to the fourth position P4. At this time, the user releases engagement by the second latches 28 by pulling up the second levers 31 of the second side-wall portion 17, and moves the second side-wall portion 17 from the third position P3 to the fourth position P4. At this time, engagement between the second engagement portions 26 of the second side-wall portion 17 and the fourth engagement portions 54 of the joint portions 18 is released. Further, when the second reinforcing plates 27 get over the respective locking projections 49 of the fifth engagement portions 21, the second side-wall portion 17 is held at the fourth position P4 by the fifth engagement portions 21.

Accordingly, for example, as in the first special use mode 61 illustrated in FIG. 22, the display case 11 in the upside-down state where the first side-wall portions 16 and the second side-wall portions 17 are placed on the lower side can be installed on the display case 11 in the normal use state where the first side-wall portions 16 and the second side-wall portions 17 are placed on the upper side. Even in this case, in the display case 11 in the upside-down state, a defect in which the second side-wall portion 17 returns from the fourth position P4 to the third position P3 by action of the gravity does not occur. This makes it possible to realize commodity display in which the front side is largely opened.

To return the second side-wall portion 17 from the fourth position P4 to the third position P3, the user raises the second side-wall portion 17 by a hand. As a result, the front ends of the fifth engagement portions 21 are bent and retracted, and the second reinforcing plates 27 can get over the respective locking projections 49 of the fifth engagement portions 21. Each of the second latches 28 of the second side-wall portion 17 has an inclined surface so as to be gradually reduced in protrusion height as the position is changed from the fourth position P4 to the third position P3. Therefore, when the user returns the second side-wall portion 17 from the fourth position P4 to the third position P3 without being conscious of presence of the second latches 28, the second latches 28 are automatically retracted into the second side-wall portion 17, and then return to the original protrusion states to engage with the second hole portions 56 of the joint portions 18. As a result, the second side-wall portion 17 is held at the third position P3.

Figure 18:
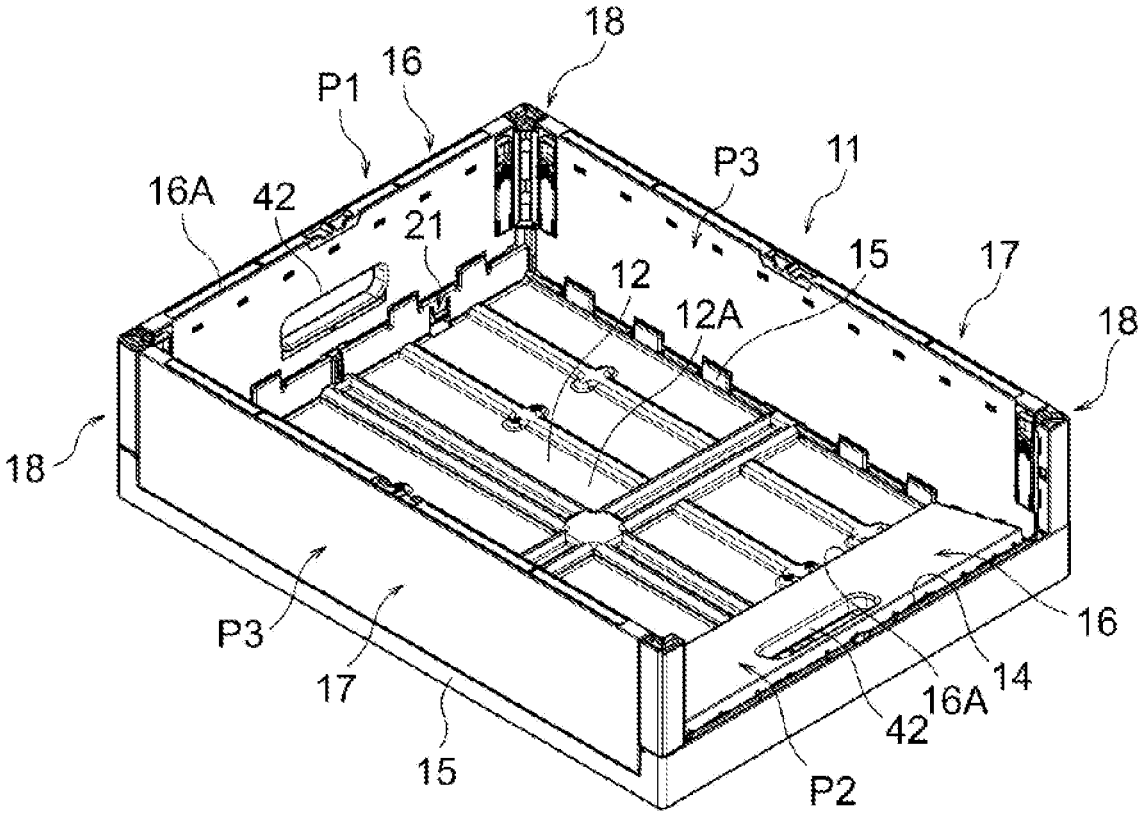
FIG. 18 is a perspective view illustrating a state where one of paired first side-wall portions is moved to a second position in the display case illustrated in FIG. 1.

As illustrated in FIG. 18, commodities can be displayed while only one of the paired first side-wall portions 16 of the display case 11 according to the present embodiment is moved from the first position P1 to the second position P2. At this time, the user releases engagement by the first latches 45 by pulling up the first levers 46 of the first side-wall portion 16, and moves the first side-wall portion 16 from the first position P1 to the second position P2. At this time, since the first connection portion 14 protrudes up to the position farther from the case main body 12 than the second connection portions 15 as obvious from FIG. 18, the first side-wall portion 16 at the second position P2 forms a slope. In other words, the first side-wall portion 16 is in contact with the case main body 12 at a front end 16A, to form the slope going away from the case main body 12 as it goes from the front end 16A toward the first connection portion 14.

In such a use mode, for example, when elongated commodities such as Japanese radishes, burdocks, and green onions are displayed, the elongated commodities can be displayed while being partially placed on the slope.

To return the first side-wall portion 16 from the second position P2 to the first position P1, it is sufficient for the user to move the first side-wall portion 16 from the second position P2 to the first position P1. Each of the first latches 45 of the first side-wall portion 16 has an inclined surface so as to be gradually reduced in protrusion height as the position is moved from the second position P2 to the first position P1. Therefore, when the user returns the first side-wall portion 16 from the second position P2 to the first position P1 without being conscious of presence of the first latches 45, the first latches 45 are automatically retracted into the first side-wall portion 16, and then return to the original protrusion states to engage with the first hole portions 55 of the joint portions 18. As a result, the first side-wall portion 16 is held at the first position P1.

Figure 21:
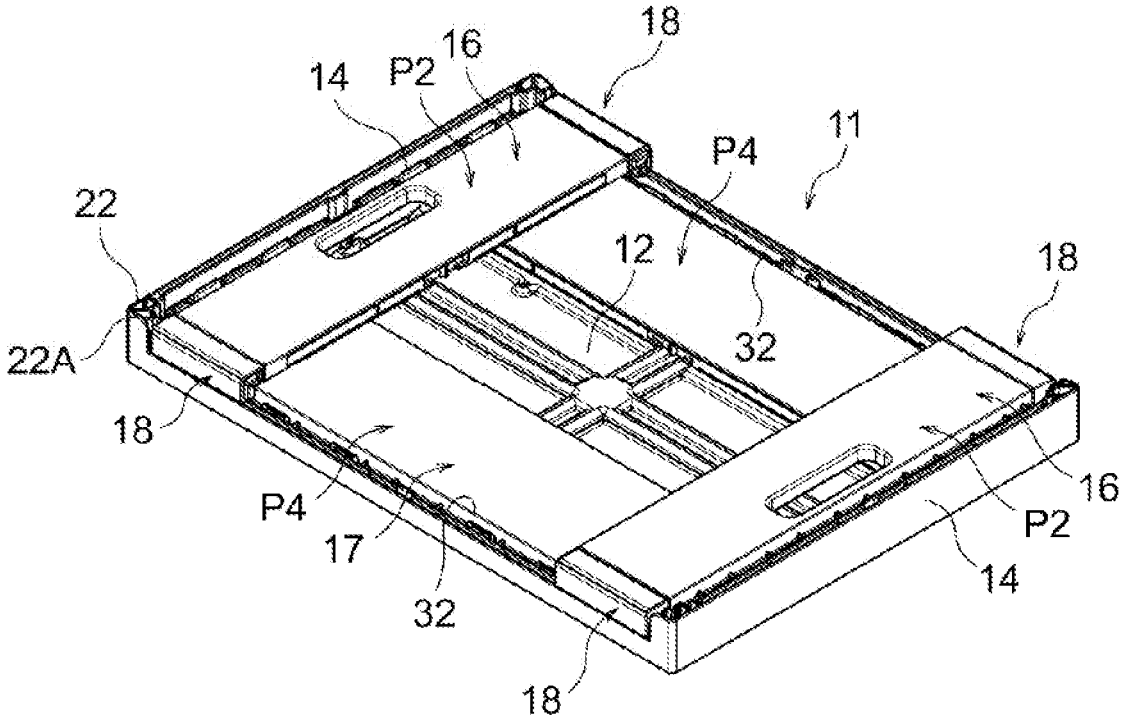
FIG. 21 is a perspective view illustrating a folded state where the first side-wall portions and the second side-wall portions of the display case illustrated in FIG. 1 fall down on the case main body.

As illustrated in FIG. 21, the display case 11 can be put into a folded state. More specifically, by a method similar to the above-described method of moving the second side-wall portion 17 from the third position P3 to the fourth position P4, each of the paired second side-wall portions 17 is moved from the third position P3 where the second side-wall portion 17 stands up to the fourth position P4 where the second side-wall portion 17 falls down on the case main body 12. Further, each of the first side-wall portions 16 is moved from the first position P1 to the second position P2 so as to fall down on the second side-wall portions 17. At this time, the first side-wall portions 16 and the joint portions 18 are smoothly moved from the first position P1 to the second position P2 by virtue of the rounded portions of the placement portions 22. At this time, the paired inner surfaces 50 of the joint portions 18 are in contact with the lower ridgelines 32 of the first side-wall portions 16 at the second position P2.

On the other hand, a folded form of the display case 11 in which the second side-wall portions 17 are positioned on the first side-wall portions 16 is prohibited. More specifically, as illustrated in FIG. 18, in the state where the first side-wall portions 16 are at the second position P2, the second side-wall portions 17 do not fall down on the first side-wall portions 16 because the joint portions 18 serve as stoppers. As a result, occurrence of a defect in which the first side-wall portions 16 placed on the lower side are damaged by a load is prevented as much as possible.

Figure 24:
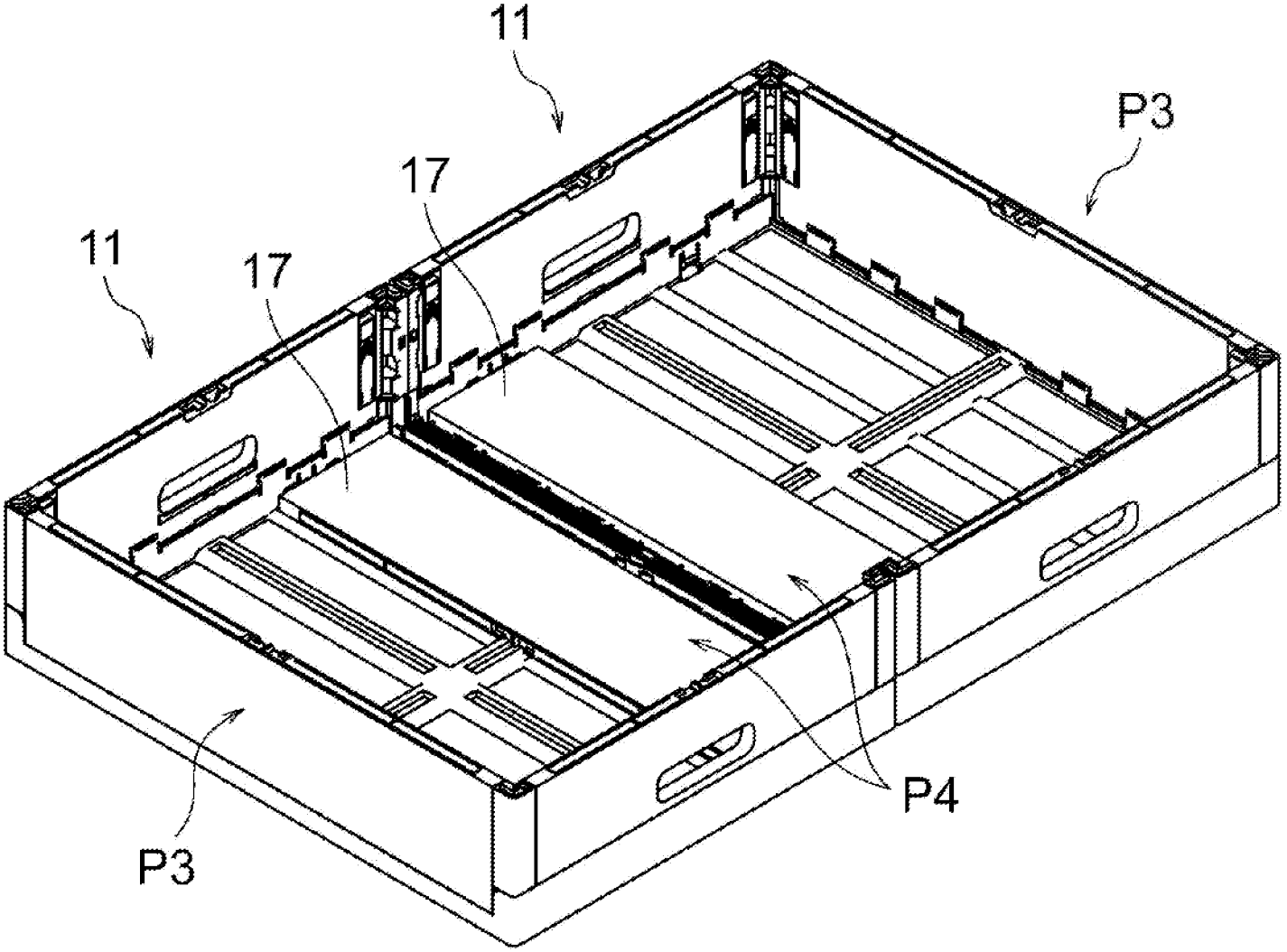
FIG. 24 is a perspective view illustrating paired display cases in a first applicable use mode.

As illustrated in FIG. 24, as a first applicable use mode of the display case 11 according to the present embodiment, the display cases 11 abut on each other while only one of the second side-wall portions 17 of each of the display cases 11 is at the fourth position P4. This enables display of elongated commodities.

Figure 25:
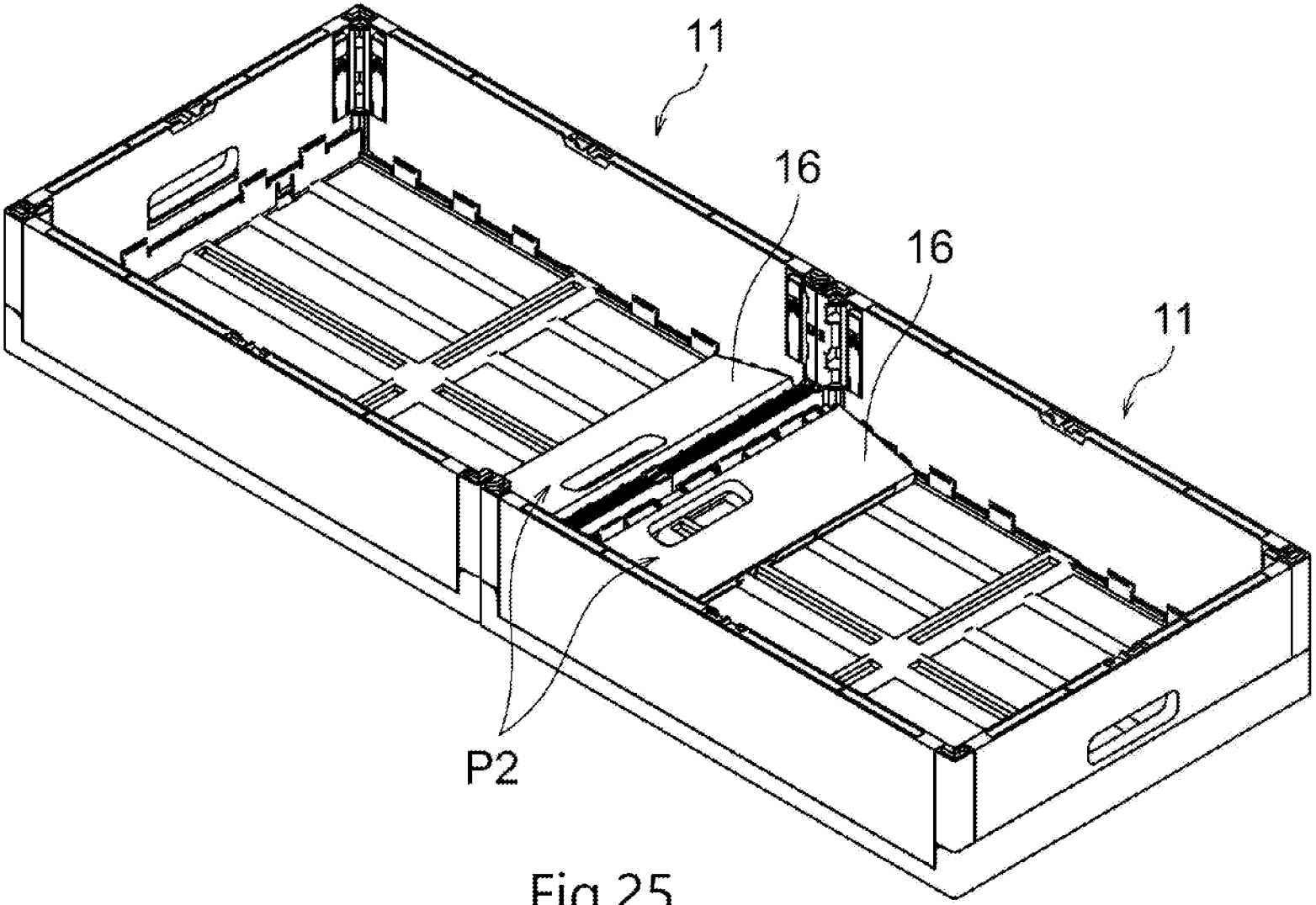
FIG. 25 is a perspective view illustrating paired display cases in a second applicable use mode.

Likewise, as illustrated in FIG. 25, as a second applicable use mode of the display case 11 according to the present embodiment, the display cases 11 abut on each other while only one of the first side-wall portions 16 of each of the display cases 11 is at the second position P2. This enables display of further elongated commodities.

Figure 26:
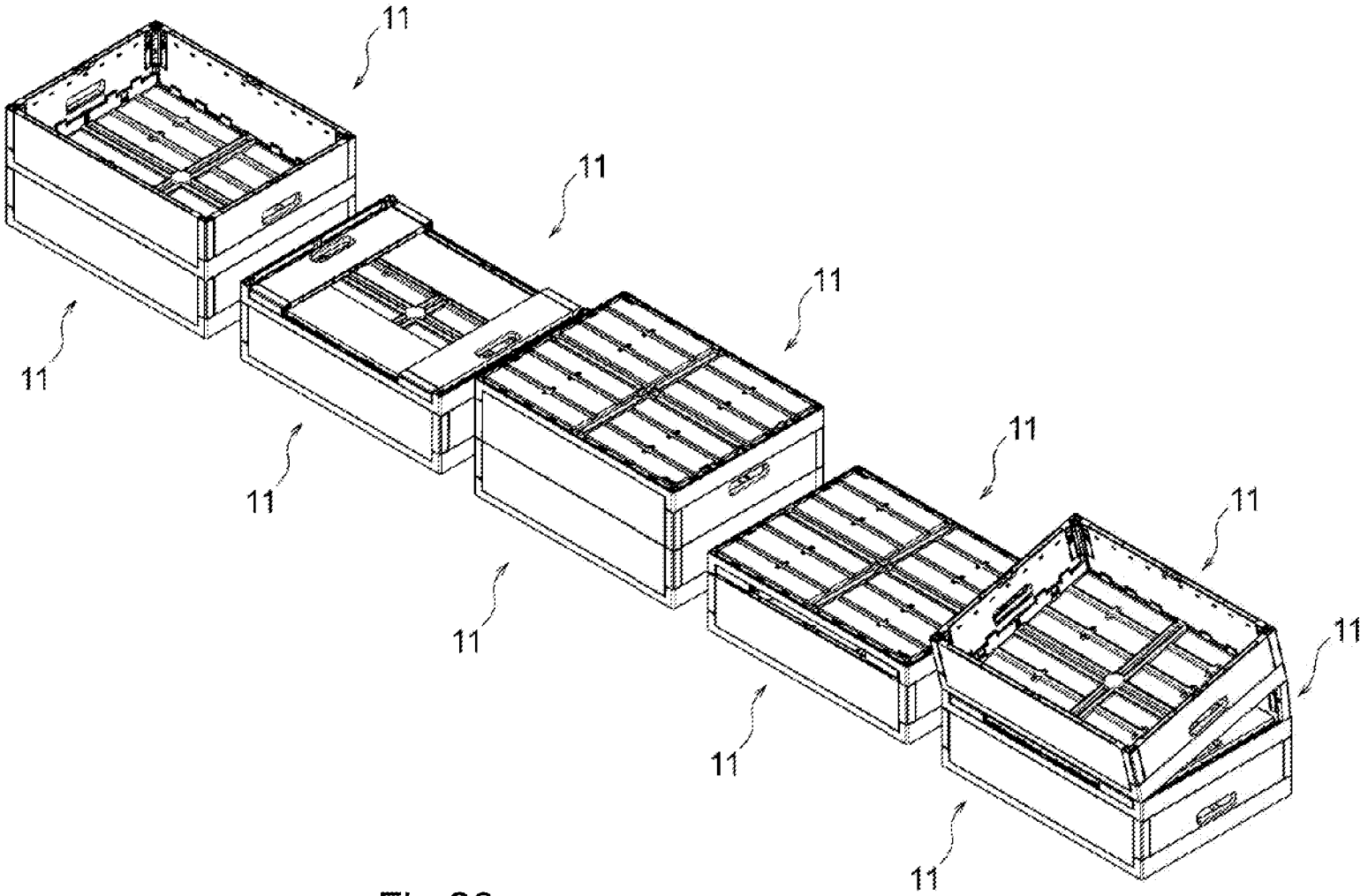
FIG. 26 is a perspective view illustrating display cases in a third applicable use mode.

FIG. 26 illustrates five third applicable use modes. Each of the third applicable use modes corresponds to a combination of the plurality of display cases 11. A mode at a left end in the drawing indicates a state where the display case in the normal use state where the first side-wall portions 16 and the second side-wall portions 17 are placed on the upper side is stacked on the display case 11 in the normal use state where the first side-wall portions 16 and the second side-wall portions 17 are placed on the upper side.

A second mode from the left in the drawing indicates a state where the display case 11 in the folded state is stacked in a direction of the normal use state on the display case 11 in the normal use state where the first side-wall portions 16 and the second side-wall portions 17 are placed on the upper side.

A third mode from the left in the drawing indicates a state where the display case 11 in the upside-down state where the first side-wall portions 16 and the second side-wall portions 17 are placed on the lower side is stacked on the display case 11 in the normal use state where the first side-wall portions 16 and the second side-wall portions 17 are placed on the upper side. In this case, the second surface 12B of the display case 11 on the upper side can be used as a display table for commodities.

A fourth mode from the left in the drawing indicates a state where the display case 11 folded while being in the upside-downstate where the first side-wall portions 16 and the second side-wall portions 17 are placed on the lower side is stacked on the display case 11 in the normal use state where the first side-wall portions 16 and the second side-wall portions 17 are placed on the upper side. In this case, the second surface 12B of the display case 11 on the upper side can be used as a display table for commodities.

A fifth mode from the left in the drawing indicates a state where the display case 11 in an oblique display adapter state is stacked on the display case 11 in the normal use state where the first side-wall portions 16 and the second side-wall portions 17 are placed on the upper side, and the display case 11 in the normal use state is obliquely stacked on the display case 11 in the oblique display adapter state.

The display case 11 in the oblique display adapter state is realized by positioning one of the paired second side-wall portions 17 at the fourth position P4, positioning the other of the paired second side-wall portion 17 at the third position P3, and positioning both of the paired first side-wall portions 16 at the second position P2. To install the display case 11 in the normal use state on the display case 11 in the oblique display adapter state, the display case 11 is installed over the sixth positioning portions 71 of the placement portions 22 on the front side and the first positioning portions 57 on the top surfaces of the joint portions 18 on the rear side. At this time, at positions on the front side, the second positioning portions 59 of the display case 11 on the upper side are fitted into the sixth positioning portions 71 of the placement portions 22 of the display case 11 on the lower side. At positions on the rear side, the second positioning portions 59 of the display case 11 on the upper side are fitted into the first positioning portions 57 of the joint portions 18 of the display case 11 on the lower side. This forms a supporting table obliquely supporting the display case such that the installation height is changed along a direction of the first sides 13 (transverse direction S).

Figure 27:
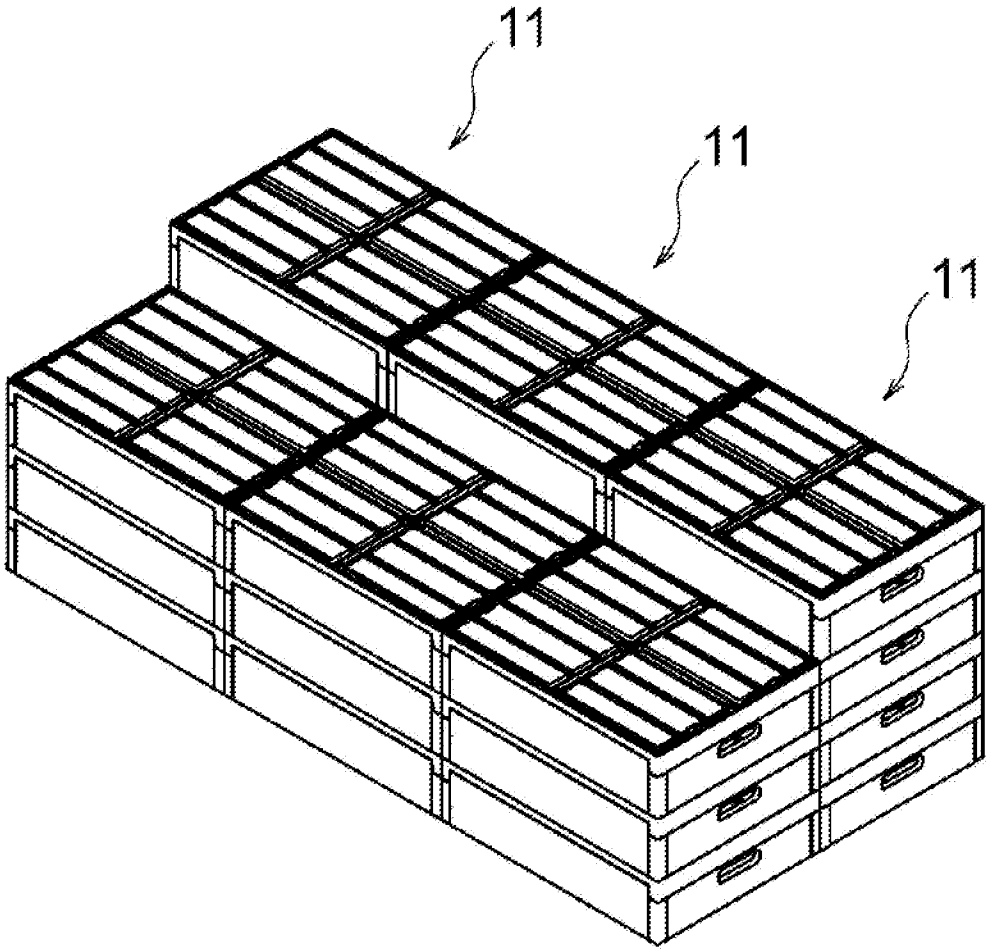
FIG. 27 is a perspective view illustrating display cases in a fourth applicable use mode.

FIG. 27 illustrates a fourth applicable use mode. In the fourth applicable use mode, the display cases 11 each in the upside-down state where the first side-wall portions 16 and the second side-wall portions 17 are placed on the lower side are stacked to constitute a display table.

Figure 28:
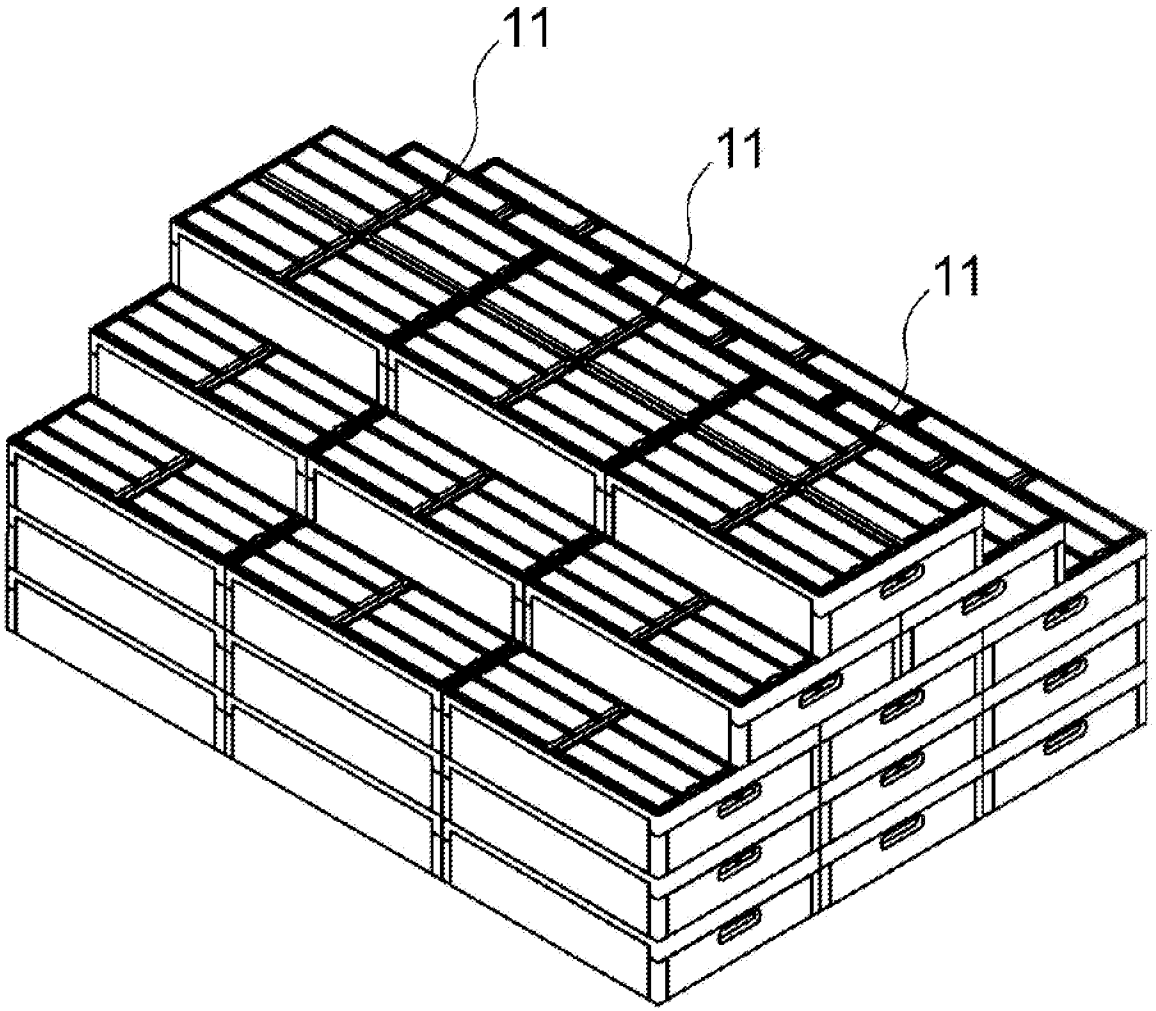
FIG. 28 is a perspective view illustrating display cases in a fifth applicable use mode.

FIG. 28 illustrates a fifth applicable use mode. As the fifth applicable use mode, an applicable use mode in which the display cases 11 each in the upside-down state where the first side-wall portions 16 and the second side-wall portions 17 are placed on the lower side are stacked to constitute a display table is illustrated. In this example, some of the display cases 11 are stacked on the display cases 11 on the lower side while being displaced by a half of the length of the display case 11 in the transverse direction S from the display cases 11 on the lower side. At this time, the display cases 11 on the upper side are fixed by fitting the first positioning portions 57 of the display cases 11 on the upper side into the fifth positioning portions 68 of the display cases 11 on the lower side. Likewise, the display cases 11 on the upper side are fixed by fitting the second positioning portions 59 of the display cases 11 on the lower side into the fourth positioning portions 64 of the display cases 11 on the upper side. The display table for commodities can be realized in such a manner.

Figure 29:
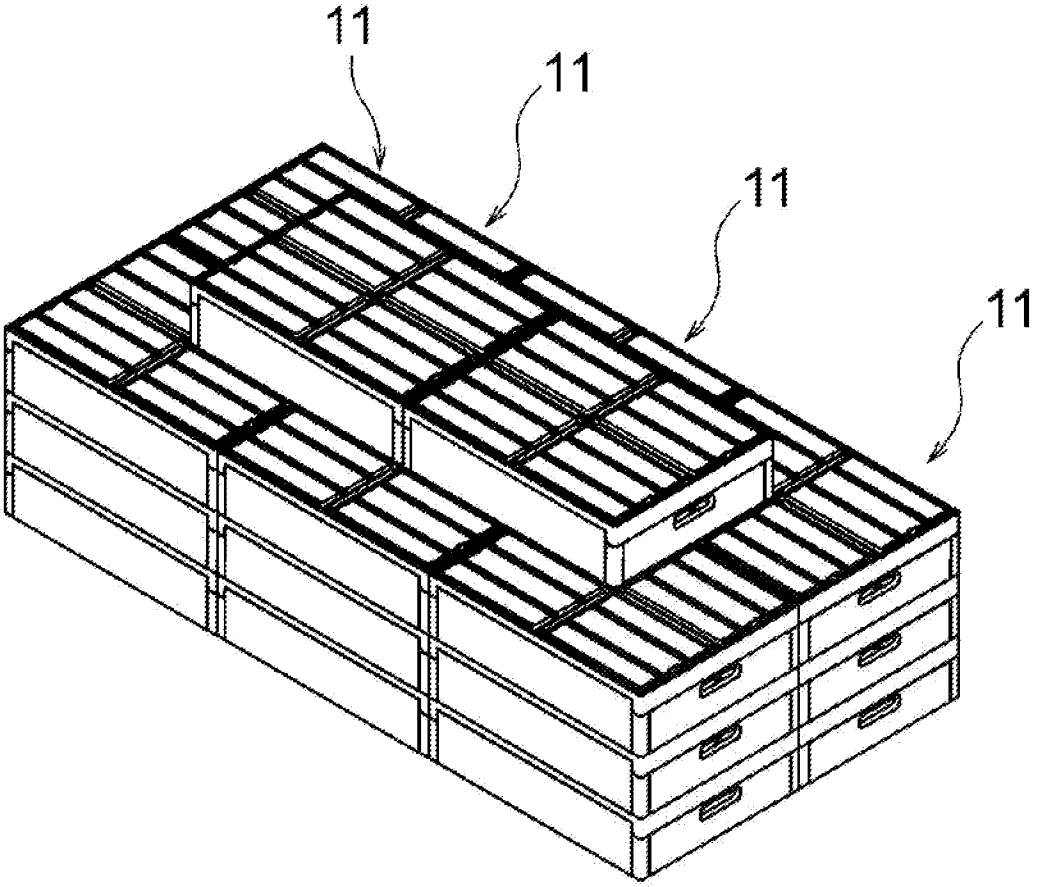
FIG. 29 is a perspective view illustrating display cases in a sixth applicable use mode.

FIG. 29 and FIG. 30 each illustrate a sixth applicable use mode. In the sixth applicable use mode, the display cases 11 each in the upside-down state where the first side-wall portions 16 and the second side-wall portions 17 are placed on the lower side are stacked to constitute a display table. In this example, some of the display cases 11 are stacked on the display cases 11 on the lower side while being displaced by a half of the length of the display case 11 in both of the longitudinal direction and the transverse direction S from the display cases 11 on the lower side, to constitute the display table like a tiered stand. At this time, the positions of the display cases 11 are fixed by fitting the first positioning portions 57 of the display cases 11 on the upper side into the third positioning portions 63 of the display cases 11 on the lower side.

Figure 31:
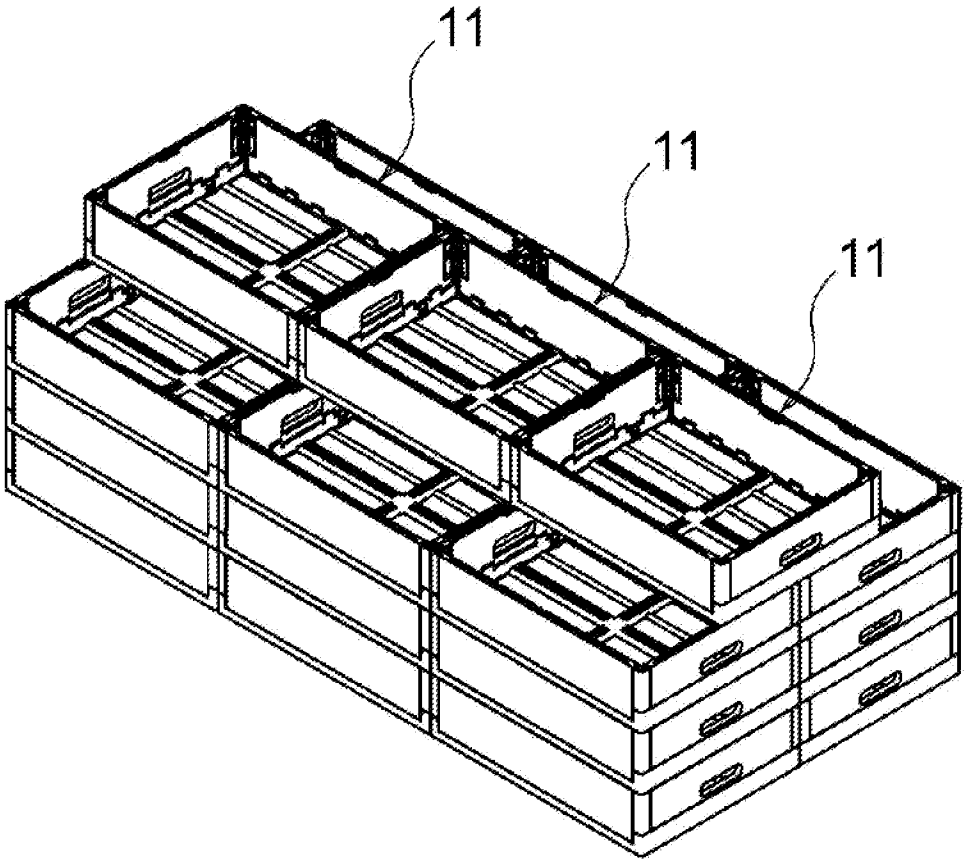
FIG. 31 is a perspective view illustrating display cases in a seventh applicable use mode.

FIG. 31 illustrates a seventh applicable use mode. In the seventh applicable use mode, the display cases 11 each in the normal use state where the first side-wall portions 16 and the second side-wall portions 17 are placed on the upper side are stacked on the display cases 11 each in the normal use state where the first side-wall portions 16 and the second side-wall portions 17 are placed on the upper side, to constitute a display table. In this case, some of the display cases 11 are stacked on the display cases 11 on the lower side while being displaced by a half of the length of the display case 11 in the transverse direction S from the display cases 11 on the lower side, to constitute the display table. At this time, the second positioning portions 59 of the display cases 11 on the upper side are fitted into the fourth positioning portions 64 of the display cases 11 on the lower side. Further, the first positioning portions 57 of the display cases 11 on the lower side are fitted into the fifth positioning portions 68 of the display cases 11 on the upper side. As a result, the positions of the display cases 11 on the upper side are fixed.

Figure 32:
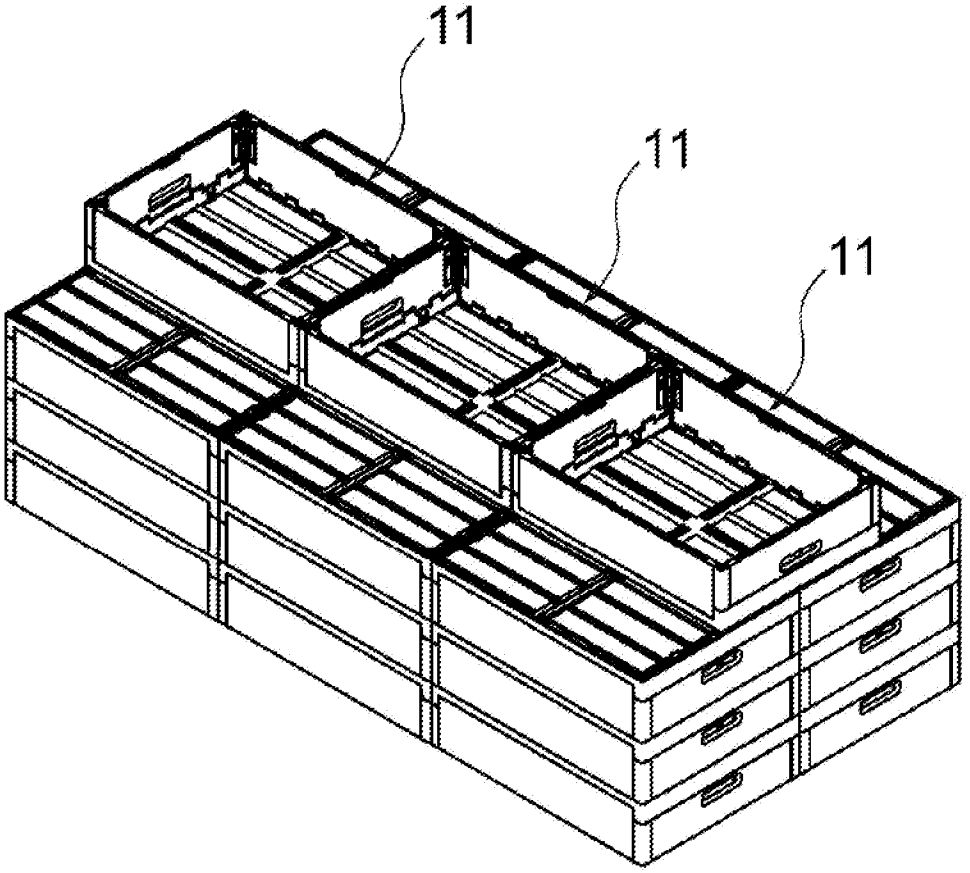
FIG. 32 is a perspective view illustrating display cases in an eighth applicable use mode.

FIG. 32 illustrates an eighth applicable use mode. In the eighth applicable use mode, the display cases 11 each in the normal use state where the first side-wall portions 16 and the second side-wall portions 17 are placed on the upper side are stacked on the display cases 11 each in the upside-down state where the first side-wall portions 16 and the second side-wall portions 17 are placed on the lower side, to constitute a display table. In this example, some of the display cases 11 are stacked on the display cases 11 on the lower side while being displaced by a half of the length of the display case 11 in the transverse direction S from the display cases 11 on the lower side, to constitute the display table. At this time, the first positioning portions 57 of the display cases 11 on the lower side are fitted into the fifth positioning portions 68 of the display cases 11 on the upper side, and the first positioning portions 57 of the display cases 11 on the upper side are fitted into the fifth positioning portions 68 of the display cases 11 on the lower side. As a result, the positions of the display cases 11 on the upper side are fixed.

Figure 33:
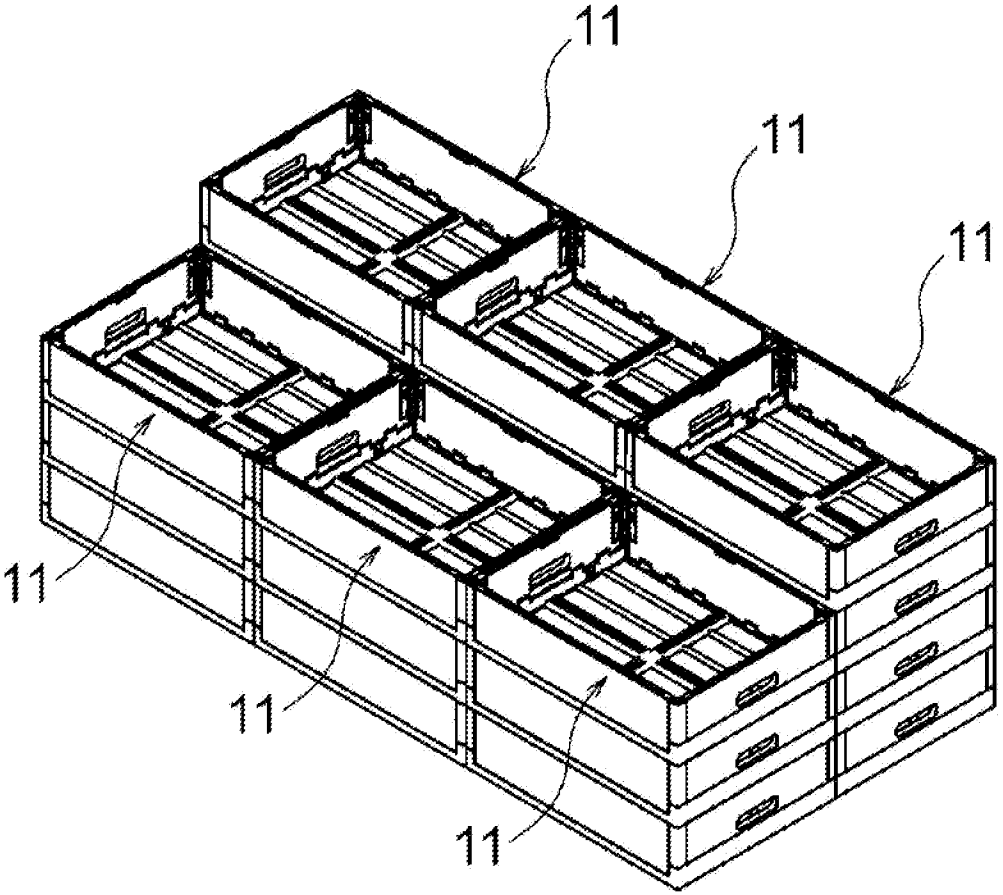
FIG. 33 is a perspective view illustrating display cases in a ninth applicable use mode.
Figure 34:
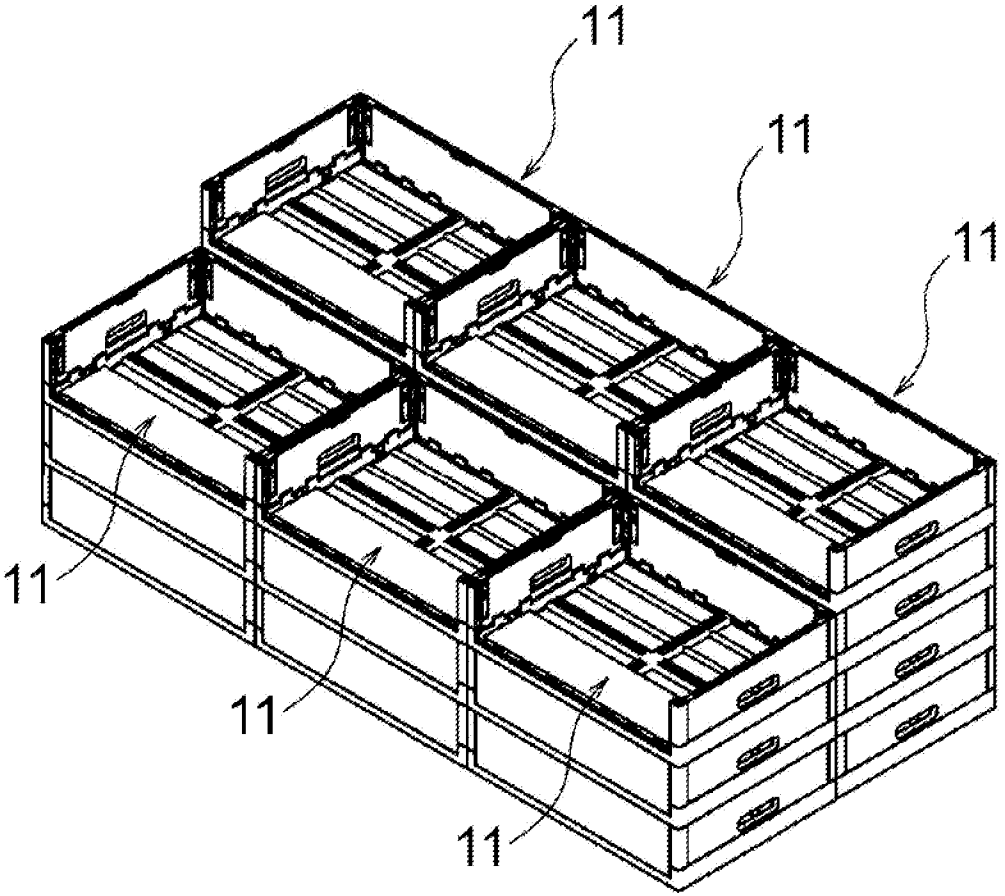
FIG. 34 is a perspective view illustrating display cases in a tenth applicable use mode.

FIG. 33 illustrates a ninth applicable use mode. As the ninth applicable use mode, an applicable use mode in which the display cases 11 each in the normal use state where the first side-wall portions 16 and the second side-wall portions 17 are placed on the upper side are stacked to constitute a display table is illustrated. FIG. 34 illustrates a tenth applicable use mode. The tenth applicable use mode is a use mode in which one of the second side-wall portions 17 positioned on the front side of each of the display cases 11 on the uppermost stage is moved to the fourth position P4 from the use mode in FIG. 33. In the use mode in FIG. 34, display that enables a customer visiting a store to easily take up commodities can be realized.

Figure 35:
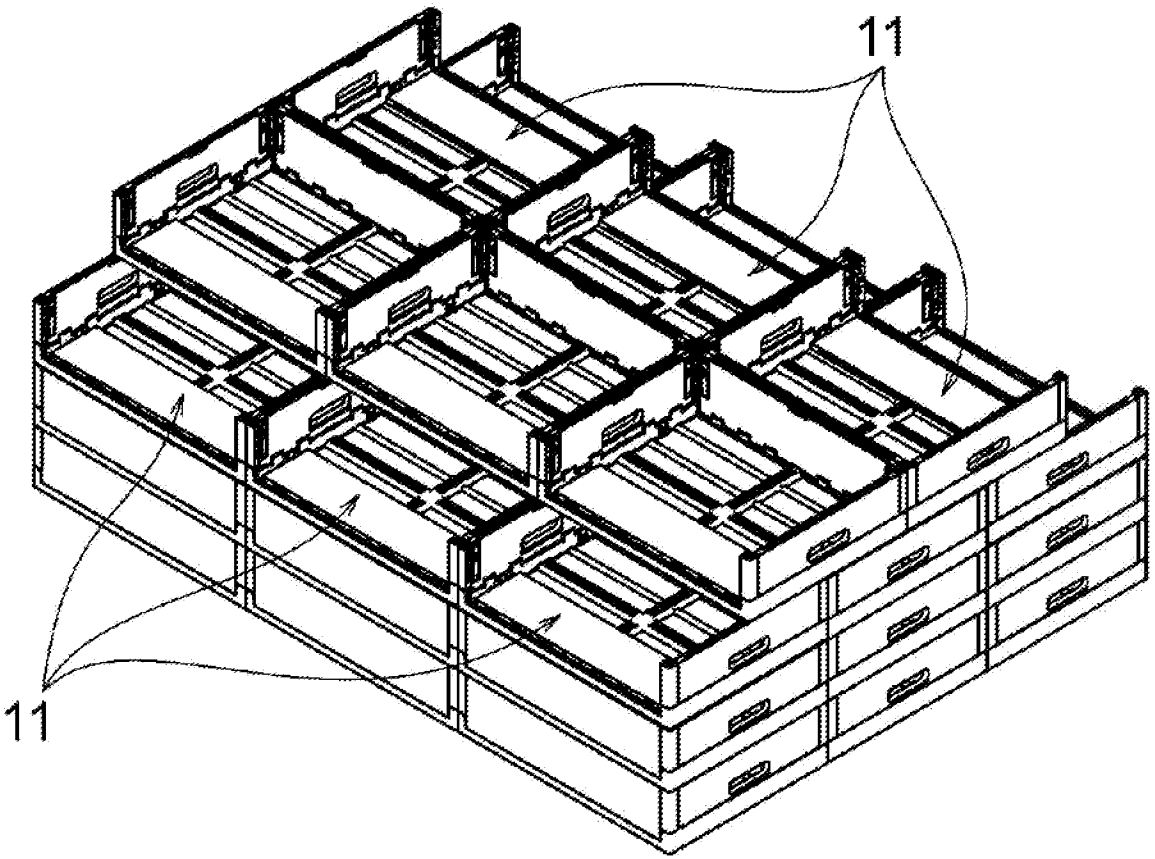
FIG. 35 is a perspective view illustrating display cases in an eleventh applicable use mode.

FIG. 35 illustrates an eleventh applicable use mode. In the eleventh applicable use mode, the display cases 11 each in the normal use state where the first side-wall portions 16 and the second side-wall portions 17 are placed on the upper side are stacked to constitute a display table. In this example, some of the display cases 11 are stacked on the display cases 11 on the lower side while being displaced by a half of the length of the display case 11 in the transverse direction S from the display cases 11 on the lower side, to constitute the display table. A basic layout is similar to the layout in FIG. 31. In this use mode, positioning the second side-wall portions 17 on passage sides at the fourth position P4 makes it possible to realize display that enables the customer visiting the store to easily take up commodities.

Figure 36:
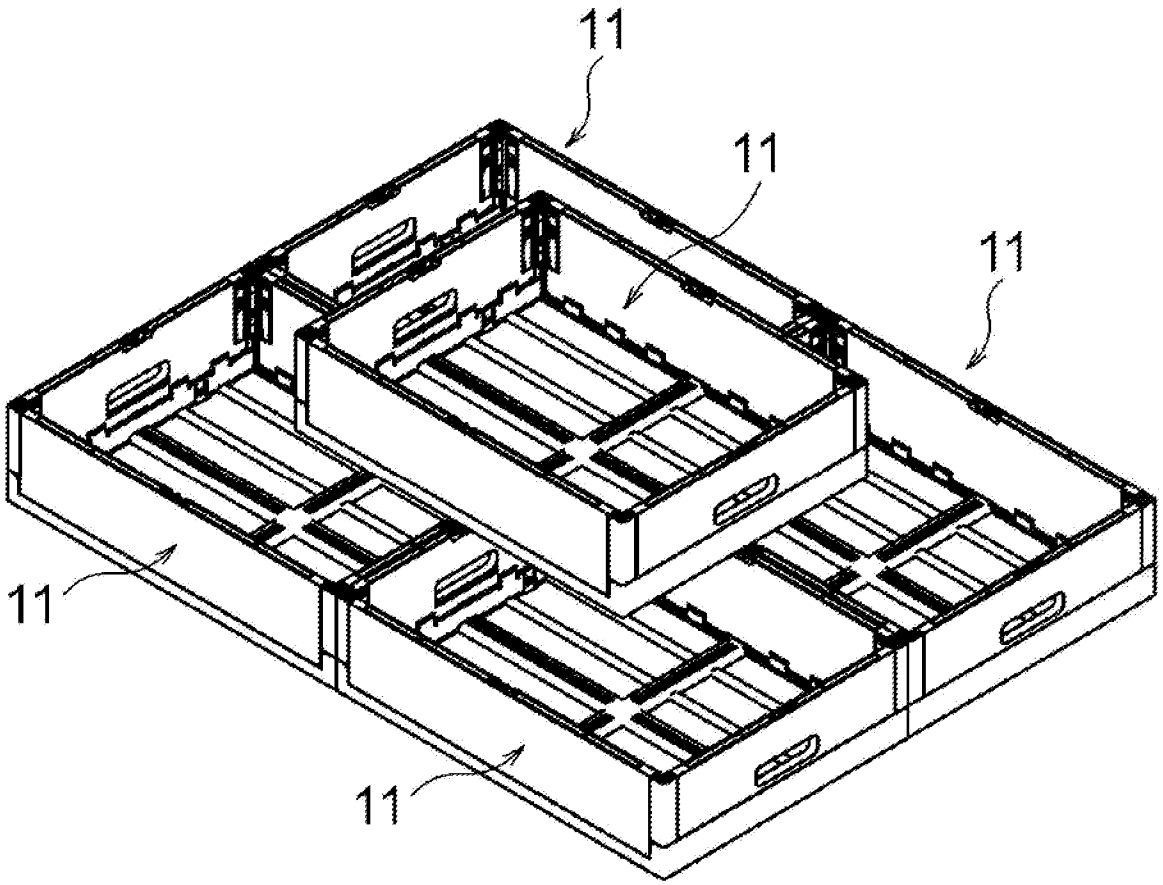
FIG. 36 is a perspective view illustrating display cases in a twelfth applicable use mode.

FIG. 36 illustrates a twelfth applicable use mode. As the twelfth applicable use mode, a state where the display case 11 in the normal use state where the first side-wall portions 16 and the second side-wall portions 17 are placed on the upper side is stacked on the display cases 11 each in the normal use state is illustrated. In this example, the display case 11 is stacked on the display cases 11 on the lower side while being displaced by a half of the length of the display case 11 in both of the longitudinal direction L and the transverse direction S, to constitute a novel display table. At this time, the position of the display case 11 on the upper side is fixed by fitting the first positioning portions 57 of the display cases 11 on the lower side into the third positioning portions 63 of the display case 11 on the upper side.

Figure 37:
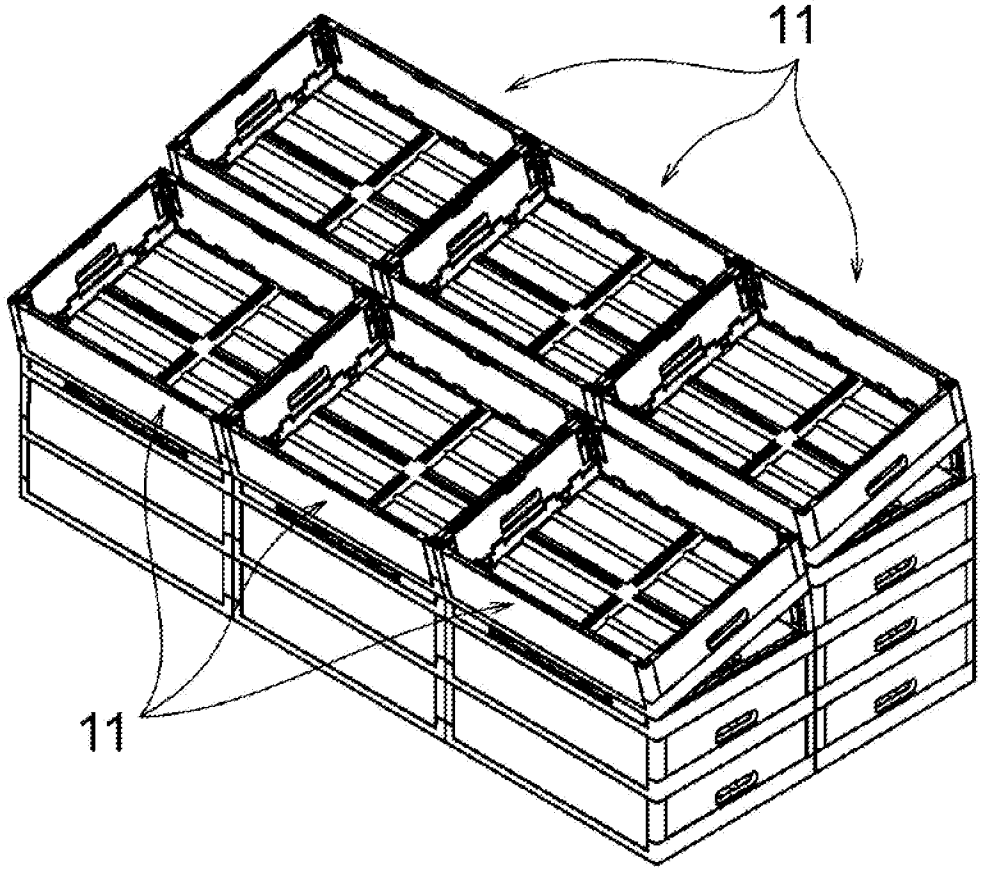
FIG. 37 is a perspective view illustrating display cases in a thirteenth applicable use mode.

FIG. 37 illustrates a thirteenth applicable use mode. In the thirteenth applicable use mode, the display cases 11 each in the normal use state where the first side-wall portions 16 and the second side-wall portions 17 are placed on the upper side are stacked to constitute a display table. The display cases 11 just below the display cases 11 on the uppermost stage are each in the oblique display adapter form as illustrated at right end in FIG. 26. As described above, the use mode in which the plurality of display cases 11 are obliquely installed along the transverse direction S can be realized.

Figure 38:
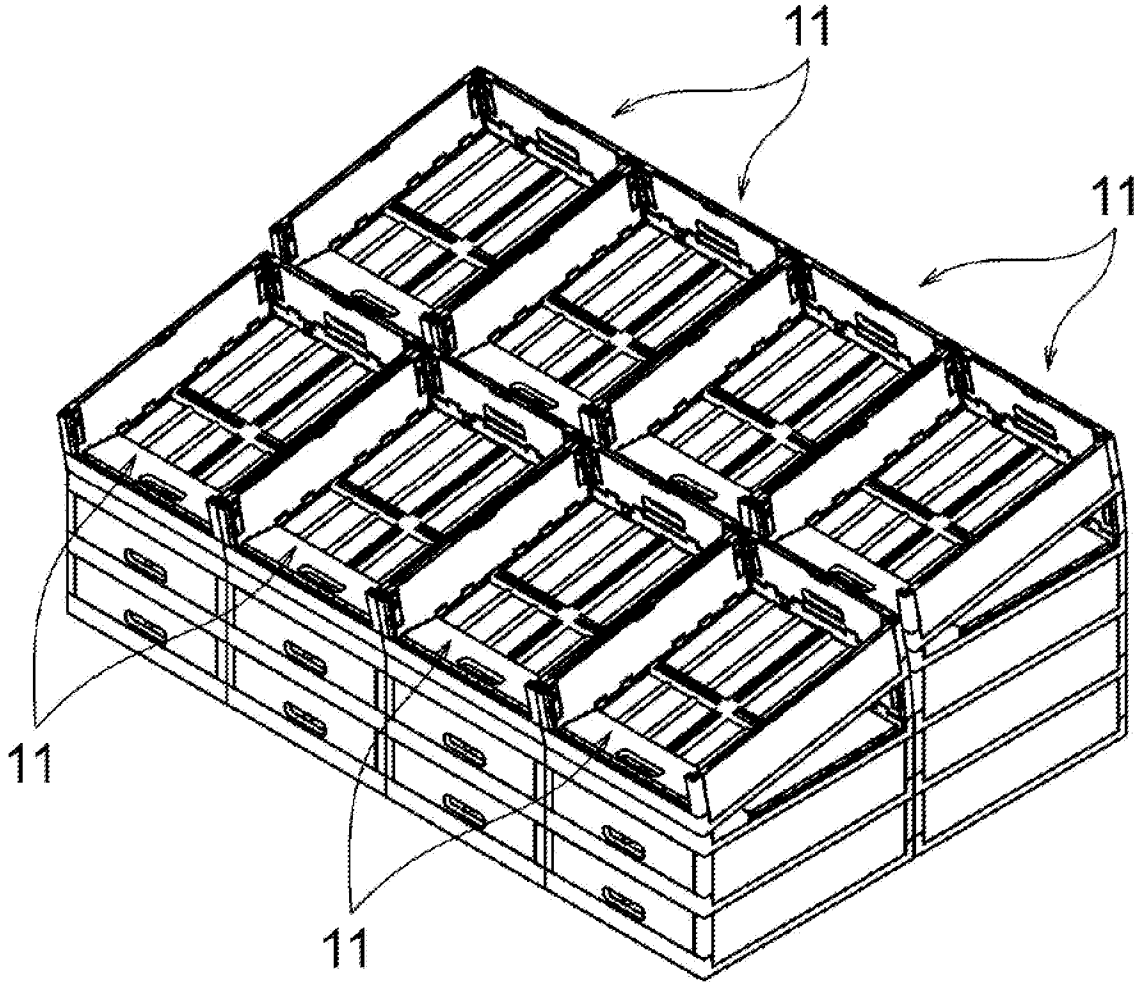
FIG. 38 is a perspective view illustrating display cases in a fourteenth applicable use mode.

FIG. 38 illustrates a fourteenth applicable use mode. As the fourteenth applicable use mode, an applicable use mode in which the display cases 11 each in the normal use state where the first side-wall portions 16 and the second side-wall portions 17 are placed on the upper side are stacked to constitute a display table is illustrated. The display cases 11 just below the display cases 11 on the uppermost stage are each in a second oblique display adapter form. In the second oblique display adapter form, the paired second side-wall portions 17 are moved to the fourth position P4. In this state, one of the first side-wall portions 16 is moved to the second position P2, and the other first side-wall portion 16 is kept at the first position P1. In this state, the display cases 11 are obliquely installed so as to straddle the sixth positioning portions 71 of the placement portions 2 on the front side and the first positioning portions 57 of the joint portions 18 on the rear side. This makes it possible to realize a use mode in which the plurality of display cases 11 are obliquely installed along the second sides 19 (longitudinal direction L).

According to the present embodiment, the followings can be said. The display case 11 includes: the case main body 12 having the square plate shape, and including the first surface 12A and the second surface 12B on the side opposite to the first surface 12A; the frame body 10 including the top surface 10A and standing up from the outer edge portion of the first surface 12A; the first convex portions 57A provided at the first corner portions 81 or peripheries of the first corner portions 81 on the top surface 10A; the first concave portions provided near the respective first convex portions and each having the shape complementary to the shape of each of the first convex portions 57A; the second convex portions provided at the second corner portions 82 or peripheries of the second corner portions 82 adjacent to the respective first corner portions 81 on the top surface 10A, and each having the shape equivalent to the shape of each of the first convex portions; and the second concave portions provided near the respective second convex portions and each having the shape complementary to the shape of each of the second convex portions, in which the second concave portions are bilaterally symmetrical to the first convex portions, and each have the shape complementary to the shape of each of the first convex portions, and the second convex portions are bilaterally symmetrical to the first concave portions, and each have the shape complementary to the shape of each of the first concave portions.

According to the configuration, for example, the display case 11 disposed to direct the frame body 10 downward can be stacked on the other display case 11 disposed to direct the frame body 10 upward. Further, even in this state, the position of the display case 11 installed on the upper side is not shifted, and the display case 11 on the upper side does not fall down.

In this case, the display case 11 includes: the third convex portions provided at the third corner portions 83 or peripheries of the third corner portions 83 on the second surface 12B opposed to the first corner portions 81; and the third concave portions provided near the respective third convex portions and each having the shape complementary to the shape of each of the third convex portions, in which the third concave portions are provided at the positions facing the respective first convex portions, and each have the shape complementary to the shape of each of the first convex portions, and the third convex portions are provided at the positions facing the respective first concave portions, and each have the shape complementary to the shape of each of the first concave portions.

According to the configuration, the display case 11 disposed to direct the frame portion 10 upward can be stacked and installed on the other display case 11 disposed to direct the frame portion 10 upward. Alternatively, the display case 11 disposed to direct the frame portion 10 downward can be stacked and installed on the other display case 11 disposed to direct the frame portion 10 downward.

The display case 11 includes, at the substantially center part on the second surface 12B, the fourth concave portions each complementary to each of the first convex portions. According to the configuration, one display case 11 can be installed at a center on four display cases 11 each disposed to direct the frame body 10 downward, to form a tiered stand. This enables three-dimensional commodity display. Further, one display case 11 disposed to direct the frame body 10 upward can be installed at a center on four display cases 11 each disposed to direct the frame body 10 upward, to realize original commodity display.

In this case, no convex portion complementary to each of the first concave portions is provided at the substantially center part on the second surface 12B. According to the configuration, in a case where commodities are arranged on the display case 11 installed to direct the frame body 10 downward, it is possible to prevent the convex portions from interfering with commodities arranged at the center part.

In this case, the frame body 10 includes the first side-wall portions 16 and the second side-wall portions 17 intersecting the first side-wall portions 16, and at least one of the first side-wall portions 16 and the second side-wall portions 17 includes the fifth concave portion complementary to each of the first convex portions, at the position that is the substantially middle part in the length direction and corresponds to the top surface 10A. According to the configuration, it is possible to realize original commodity display in which the display case 11 is installed on the other display case 11 installed to direct the frame body 10 upward while being displaced by a half of the length of the display case 11.

The display case 11 includes: the case main body 12 having the square plate shape, and including the first surface 12A and the second surface 12B on a side opposite to the first surface 12A; the paired first connection portions 14 protruding from the paired first sides 13 of the outer edge portion of the case main body 12; the paired second connection portions 15 protruding from the paired second sides 19 of the outer edge portion, and protruding at the positions closer to the case main body 12 than the paired first connection portions 14; the paired first side-wall portions 16 each configured to be turnable between the first position P1 where the first side-wall portion 16 stands up from the case main body 12 and the second position P2 where the first side-wall portion 16 falls down on the case main body 12, around the corresponding one of the paired first connection portions 14, and each including the first engagement portions 43; the paired second side-wall portions 17 each configured to be turnable between the third position P3 where the second side-wall portion stands up from the case main body 12 and the fourth position P4 where the second side-wall portion 17 falls down on the case main body 12, around the corresponding one of the paired second connection portions 15, and each including the second engagement portions 26; the plurality of placement portions 22 provided at the respective corners of the case main body 12; the plurality of joint portions 18 placed on the respective placement portions 22, each of the plurality of joint portions 18 including the third engagement portions 53 engageable with and disengageable from the first engagement portions 43 of the turning first side-wall portion 16, and the fourth engagement portions 54 engageable with and disengageable from the second engagement portions 26 of the turning second side-wall portion 17, the plurality of joint portions 18 being configured to turn with the first side-wall portions 16 turning to the second position P2 while the second side-wall portions 17 are at the fourth position P4 and the first engagement portions 43 and the third engagement portions 53 engage with each other, to expose the placement portions 22; the at least one paired third convex portions provided at the paired corner portions at the diagonal positions on the second surface 12B; the plurality of first concave portions provided on the respective top parts of the plurality of joint portions 18 and each having the shape complementary to the shape of each of the third convex portions; and the plurality of seventh concave portions provided on the respective placement portions 22 and each having the shape complementary to the shape of each of the third convex portions.

According to the configuration, one of the second side-wall portions 17 is set at the fourth position P4, the other second side-wall portion 17 is set at the third position P3, and the paired first side-wall portions 16 are set at the second position P2 together with the joint portions 18 on a side opposite to the joint portions 18 adjacent to the second side-wall portion 17 at the third position P3. This can cause the display case 11 to serve as an oblique supporting table. In other words, the other display cases 11 in the same form are caused to straddle the first concave portions and sixth concave portions, which makes it possible to cause the display cases 11 to serve as the supporting table obliquely supporting the display cases 11 so as to change the installation height along the direction of the first sides 13.

Likewise, according to the above-described configuration, even when the paired second side-wall portions 17 are set at the fourth position P4, one of the first side-wall portions 16 is set at the second position P2, and the other first side-wall portion 16 is set at the first position P1, it is also possible to cause the display case 11 to serve as the oblique supporting table. In other words, the other display cases 11 in the same form are caused to straddle the first concave portions and the sixth concave portions, which makes it possible to cause the display cases 11 to serve as the supporting table obliquely supporting the display cases 11 so as to change the installation height along the direction of the second sides 19.

The above-described embodiment and modifications can be implemented while being added with various replacements and deformations. More specifically, in the above-described embodiment and modifications, the first connection portions 14 protrude to the positions farther from the case main body 12 than the second connection portions 15; however, the form is not limited thereto. For example, the second connection portions 15 may protrude up to positions farther from the case main body 12 than the first connection portions 14 as a matter of course.

Further, in the above-described embodiment, the first convex portions (convex portions 57A) are provided on the respective first corner portions 81; however, the first convex portions may be provided on the peripheries of the respective first corner portions 81, namely, not on the joint portions 18 but on the first side-wall portions 16 or the second side-wall portions 17. Likewise, the first concave portions (concave portions 57B) are provided on the respective first corner portions 81; however, the first concave portions may be provided on the peripheries of the respective first corner portions 81, namely, not on the joint portions 18 but on the first side-wall portions 16 or the second side-wall portions 17. Likewise, the third convex portions (convex portions 59A) are provided at the respective third corner portions 83; however, the third convex portions may be provided on the peripheries of the respective third corner portions 83, namely, at respective positions deviated from the third corner portions 83 and near the third corner portions 83. Likewise, the third concave portions (concave portions 59B) are provided at the respective third corner portions 83; however, the third concave portions may be provided on the peripheries of the respective third corner portions 83, namely, at respective positions deviated from the third corner portions 83 and near the third corner portions 83.

Figure 39:
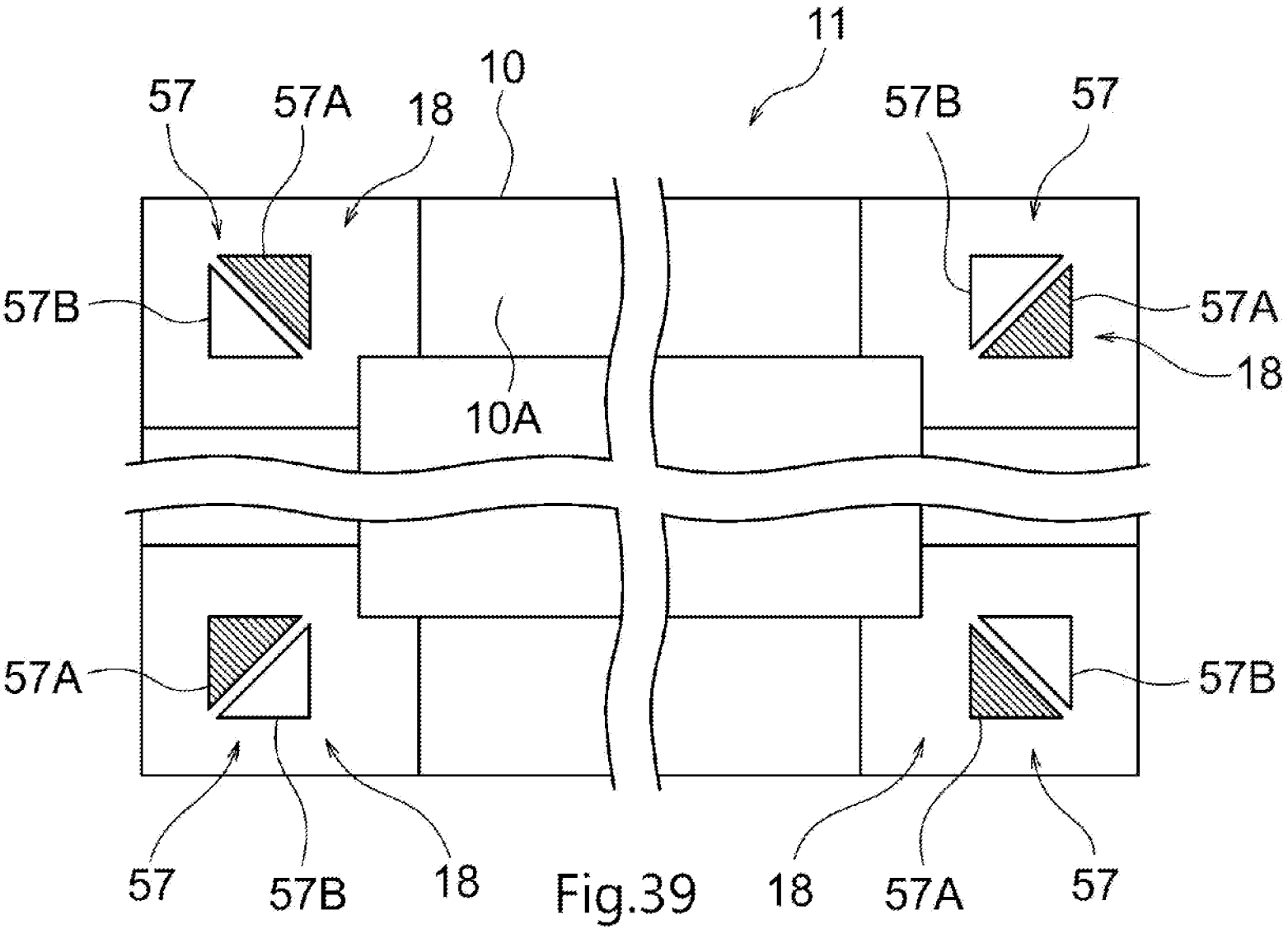
FIG. 39 is a plan view illustrating a display case according to a first modification.

The shapes of the first to sixth positioning portions 57 to 71 are not limited to the shapes according to the above-described embodiment. For example, as in a first modification illustrated in FIG. 39, a shape (square shape) obtained by combining two triangles may be adopted. More specifically, each of the first positioning portions 57 (each of second positioning portions 59) includes the convex portion 57A (59A) having a right-angled triangle shape, and the concave portion 57B (59B) having a right-angled triangle shape complementary to the shape of the convex portion 57A. The concave portion 57B (59B) is provided near the convex portion 57A (59A). In the first modification, the shapes of the third to sixth positioning portions 63 to 71 can be realized as shapes appropriately complementary to the shapes of the first positioning portions 57 (second positioning portions 59) as in the above-described embodiment. The modification also achieves action and effects similar to the action and effects by the above-described embodiment.

Figure 40:
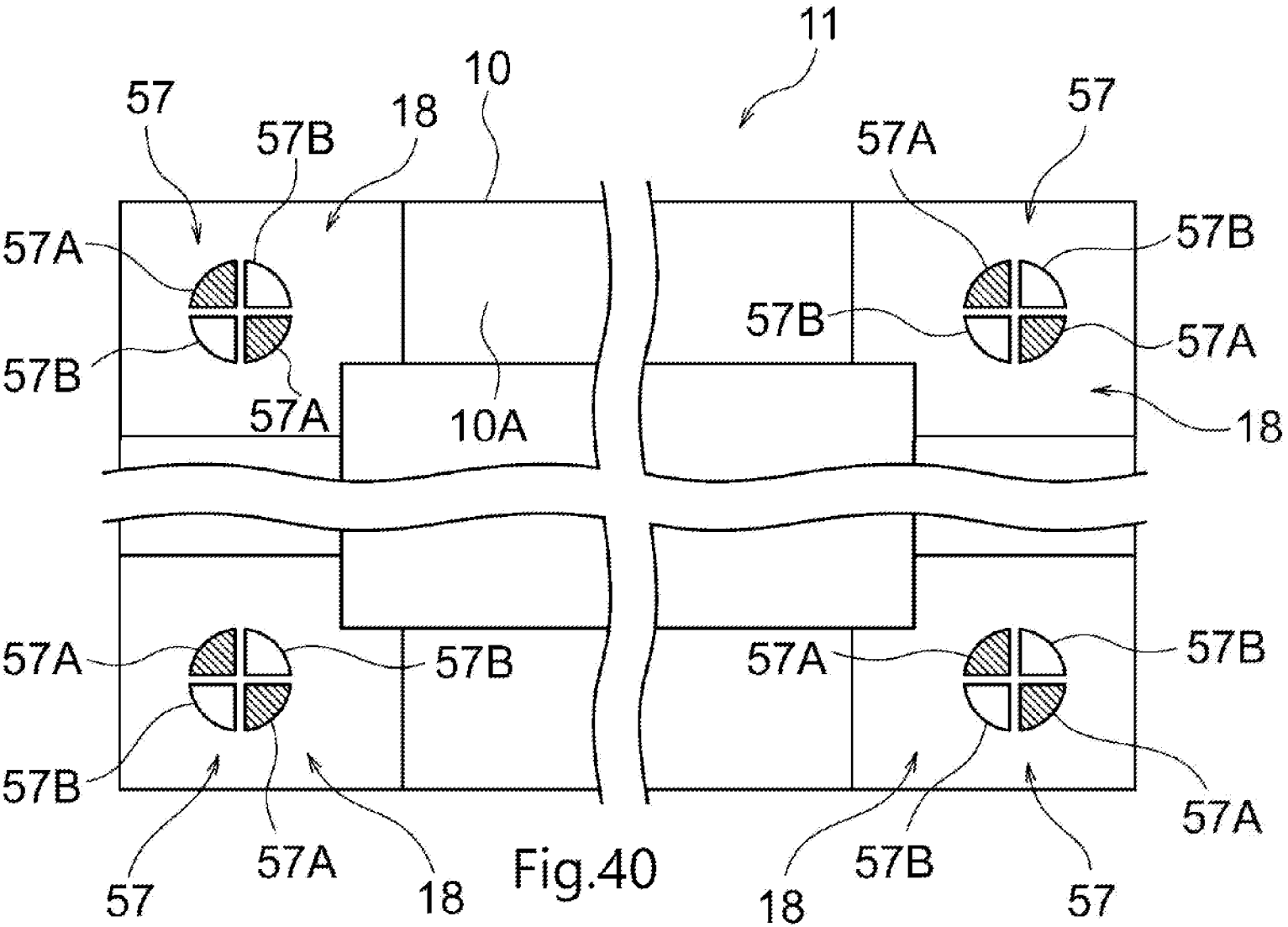
FIG. 40 is a plan view illustrating a display case according to a second modification.

For example, as in a second modification illustrated in FIG. 40, a shape (circular shape) obtained by combining four fan shapes may be adopted. More specifically, each of the first positioning portions 57 (each of second positioning portions 59) includes two convex portions 57A (59A) each formed in a fan shape having a right center angle, and two concave portions 57B (59B) each formed in a fan shape having a right center angle, complementary to the shape of each of the convex portions 57A. The concave portions 57B (59B) are provided near the convex portions 57A (59A). In the second modification, the shapes of the third to sixth positioning portions 63 to 71 can be realized as shapes appropriately complementary to the shapes of the first positioning portions 57 (second positioning portions 59) as in the above-described embodiment. The modification also achieves action and effects similar to the action and effects by the above-described embodiment.

Figure 41:
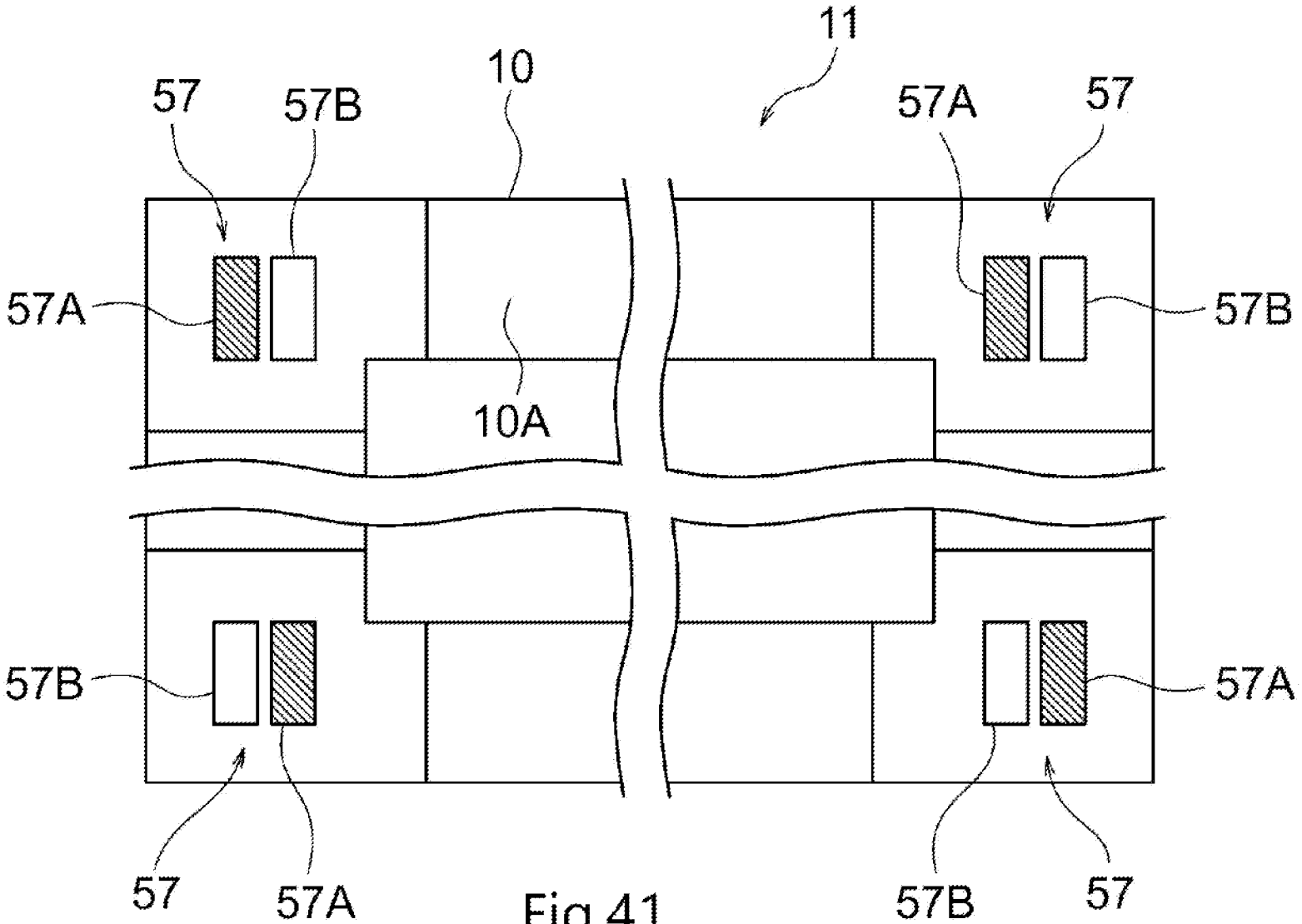
FIG. 41 is a plan view illustrating a display case according to a third modification.

For example, as in a third modification illustrated in FIG. 41, a shape (square shape) obtained by combining two rectangles may be adopted. More specifically, each of the first positioning portions 57 (each of second positioning portions 59) includes the convex portion 57A (59A) formed in a rectangle, and two concave portions 57B (59B) each formed in a rectangle, complementary to the shape of the convex portion 57A. The concave portion 57B (59B) is provided near the convex portion 57A (59A). In the third modification, the shapes of the third to sixth positioning portions 63 to 71 can be realized as shapes appropriately complementary to the shapes of the first positioning portions 57 (second positioning portions 59) as in the above-described embodiment. The modification also achieves action and effects similar to the action and effects by the above-described embodiment.

REFERENCE SIGNS LIST

10 frame body
10A top surface
11 display case
12 case main body
S transverse direction
13 first side
14 first connection portion
L longitudinal direction
15 second connection portion
16 first side-wall portion
17 second side-wall portion
18 joint portion
19 second side
22 placement portion
26 second engagement portion
P3 third position
P4 fourth position
43 first engagement portion
P1 first position
P2 second position
53 third engagement portion
54 fourth engagement portion

The invention claimed is:

1. A display case, comprising:

a case main body having a square plate shape, and including a first surface and a second surface on a side opposite to the first surface;

a frame body including a top surface and standing up from an outer edge portion of the first surface;

first convex portions provided at any of first corner portions and peripheries of the first corner portions on the top surface;

first concave portions provided near the respective first convex portions and each having a shape complementary to a shape of each of the first convex portions;

second convex portions provided at any of second corner portions and peripheries of the second corner portions adjacent to the respective first corner portions on the top surface, and each having a shape equivalent to the shape of each of the first convex portions;

second concave portions provided near the respective second convex portions and each having a shape complementary to the shape of each of the second convex portions, third convex portions provided at any of third corner portions and peripheries of the third corner portions on the second surface opposed to the first corner portions; and third concave portions provided near the respective third convex portions and each having a shape complementary to a shape of each of the third convex portions, wherein the third concave portions are provided at positions facing the respective first convex portions, and each have the shape complementary to the shape of each of the first convex portions, and the third convex portions are provided at positions facing the respective first concave portions, and each have the shape complementary to the shape of each of the first concave portions, fourth concave portions each complementary to each of the first convex portions, the fourth concave portions provided at a substantially center part on the second surface, wherein the second concave portions are bilaterally symmetrical to the first convex portions, and each have the shape complementary to the shape of each of the first convex portions, and the second convex portions are bilaterally symmetrical to the first concave portions, and each have the shape complementary to the shape of each of the first concave portions.

2. The display case according to claim 1, wherein no convex portion complementary to each of the first concave portions is provided at the substantially center part on the second surface.

3. The display case according to claim 1, wherein the frame body includes first side-wall portions and second side-wall portions intersecting the first side-wall portions, and at least one of the first side-wall portions and the second side-wall portions includes a fifth concave portion complementary to each of the first convex portions, at a position that is a substantially middle part in a length direction and corresponds to the top surface.

4. The display case according to claim 3, wherein at least one of middle parts in a longitudinal direction L of the outer edge portion on the second surface and middle parts in a transverse direction S of the outer edge portion on the second surface includes a sixth concave portion complementary to each of the first convex portions.

5. A display case, comprising:

a case main body having a square plate shape, and including a first surface and a second surface on a side opposite to the first surface;

paired first connection portions protruding from paired first sides of an outer edge portion of the case main body;

paired second connection portions protruding from paired second sides of the outer edge portion, and protruding at positions closer to the case main body than the paired first connection portions;

paired first side-wall portions each configured to be turnable between a first position where the first side-wall portion stands up from the case main body and a second position where the first side-wall portion falls down on the case main body, around the corresponding one of the paired first connection portions, and each including first engagement portions;

paired second side-wall portions each configured to be turnable between a third position where the second side-wall portion stands up from the case main body and a fourth position where the second side-wall portion falls down on the case main body, around the corresponding one of the paired second connection portions, and each including second engagement portions;

a plurality of placement portions provided at respective corners on the first surface of the case main body;

a plurality of joint portions placed on the respective placement portions, each of the plurality of joint portions including third engagement portions engageable with and disengageable from the first engagement portions of the turning first side-wall portion, and fourth engagement portions engageable with and disengageable from the second engagement portions of the turning second side-wall portion, the plurality of joint portions being configured to turn with the first side-wall portions turning to the second position, to expose the placement portions;

at least one paired first convex portions provided at paired corner portions at diagonal positions on the second surface;

a plurality of first concave portions provided on respective top parts of the plurality of joint portions and each having a shape complementary to the shape of each of the first convex portions; and a plurality of second concave portions provided on the plurality of placement portions and each having a shape complementary to the shape of each of the first convex portions.

* * * * *